US010859963B2

(12) United States Patent
Nakayama et al.

(10) Patent No.: US 10,859,963 B2
(45) Date of Patent: Dec. 8, 2020

(54) IMAGE FORMING APPARATUS, IMAGE FORMING METHOD, AND PROCESS CARTRIDGE

(71) Applicants: Shinya Nakayama, Shizuoka (JP); Keiichiro Juri, Kanagawa (JP); Yuka Aoyama, Kanagawa (JP); Hiroshi Yamada, Shizuoka (JP)

(72) Inventors: Shinya Nakayama, Shizuoka (JP); Keiichiro Juri, Kanagawa (JP); Yuka Aoyama, Kanagawa (JP); Hiroshi Yamada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/822,092

(22) Filed: Mar. 18, 2020

(65) Prior Publication Data

US 2020/0301348 A1 Sep. 24, 2020

(30) Foreign Application Priority Data

Mar. 19, 2019 (JP) ..... 2019-051210

(51) Int. Cl.
*G03G 21/00* (2006.01)

(52) U.S. Cl.
CPC ..... *G03G 21/0017* (2013.01)

(58) Field of Classification Search
CPC .. G03G 21/007; G03G 15/162; G03G 5/0525; G03G 5/071
See application file for complete search history.

(56) References Cited

U.S. PATENT DOCUMENTS

2012/0063826 A1* 3/2012 Ohmori ..... G03G 15/0225 399/350
2013/0243506 A1* 9/2013 Ikuno ..... G03G 21/0017 399/350

(Continued)

FOREIGN PATENT DOCUMENTS

JP 4-212190 8/1992
JP 9-127846 5/1997

(Continued)

OTHER PUBLICATIONS

U.S. Appl. No. 16/583,861, filed Sep. 26, 2019, Yohichi Kitagawa, et al.

*Primary Examiner* — Francis C Gray
(74) *Attorney, Agent, or Firm* — Oblon, McClelland, Maier & Neustadt, L.L.P.

(57) ABSTRACT

An image forming apparatus including an image bearer and a cleaning blade is provided. The cleaning blade comprises an elastic member configured to contact a surface of the image bearer to remove toner particles remaining thereon. The elastic member comprises a substrate and a surface layer comprising a cured product of a curable composition and a siloxane compound. The surface layer is disposed on at least a part of a lower surface of the substrate. The surface layer has a hardness gradient in which a Martens hardness HM measured using a nanoindenter decreases from a surface of the surface layer toward the lower surface of the substrate in a thickness direction, and the Martens hardness HM measured in a region extending from a vicinity of the surface (with a load of 1 μN) to a deepest part in the thickness direction (with a load of 1,000 μN) ranges from 2.5 to 32.5 N/mm$^2$. The toner has a tensile breaking force F of from 200 to 450 gf (from 1.96 to 4.41 N), measured using a powder (Continued)

layer compression/tensile strength measurement device under a load of 32 kgf (313.81 N).

9 Claims, 9 Drawing Sheets

(56) References Cited

U.S. PATENT DOCUMENTS

| | | | | |
|---|---|---|---|---|
| 2013/0243507 | A1* | 9/2013 | Sakon | G03G 21/0017 399/350 |
| 2014/0205338 | A1* | 7/2014 | Gondoh | G03G 21/0017 399/350 |
| 2015/0139711 | A1* | 5/2015 | Gohda | G03G 21/0017 399/350 |
| 2016/0259257 | A1 | 9/2016 | Sugimoto et al. | |
| 2016/0259273 | A1 | 9/2016 | Izutani et al. | |
| 2016/0274489 | A1 | 9/2016 | Juri et al. | |
| 2016/0274500 | A1 | 9/2016 | Juri et al. | |
| 2016/0274527 | A1 | 9/2016 | Gohda et al. | |
| 2016/0320740 | A1 | 11/2016 | Toyama et al. | |
| 2016/0334726 | A1 | 11/2016 | Sakashita et al. | |
| 2016/0370720 | A1 | 12/2016 | Yamashita et al. | |
| 2017/0003643 | A1 | 1/2017 | Aoyama et al. | |
| 2017/0108791 | A1 | 4/2017 | Hashida et al. | |
| 2017/0363980 | A1 | 12/2017 | Nagata et al. | |
| 2018/0017930 | A1 | 1/2018 | Aoyama et al. | |
| 2018/0224763 | A1 | 8/2018 | Tanaka et al. | |
| 2018/0239297 | A1 | 8/2018 | Juri et al. | |
| 2018/0253022 | A1 | 9/2018 | Takeda et al. | |
| 2018/0321606 | A1 | 11/2018 | Ohnuma et al. | |
| 2019/0171122 | A1 | 6/2019 | Ukigaya et al. | |
| 2019/0324382 | A1* | 10/2019 | Sugiyama | G03G 15/0815 |

FOREIGN PATENT DOCUMENTS

| | | |
|---|---|---|
| JP | 9-166919 | 6/1997 |
| JP | 2004-233818 | 8/2004 |
| JP | 2010-152295 | 7/2010 |
| JP | 2011-185984 | 9/2011 |
| JP | 2015-096890 | 5/2015 |

* cited by examiner

IMAGE FORMING APPARATUS, IMAGE FORMING METHOD, AND PROCESS CARTRIDGE

CROSS-REFERENCE TO RELATED APPLICATIONS

This patent application is based on and claims priority pursuant to 35 U.S.C. § 119(a) to Japanese Patent Application No. 2019-051210, filed on Mar. 19, 2019, in the Japan Patent Office, the entire disclosure of which is hereby incorporated by reference herein.

BACKGROUND

Technical Field

The present disclosure relates to an image forming apparatus, an image forming method, and a process cartridge.

Description of the Related Art

In a conventional electrophotographic image forming apparatus, a toner image on an image bearer (hereinafter "photoconductor", "electrophotographic photoconductor", or "electrostatic latent image bearer") is transferred onto a transfer sheet or an intermediate transferor. After that, unnecessary substances adhered to the surface of the image bearer, such as untransferred residual toner particles, are removed from the image bearer by a cleaner.

As the cleaner, a strip-shaped cleaning blade is generally well known because of its simple structure and excellent cleaning performance. With the base end supported by a support and the contact part (leading end ridge part) pressed against the peripheral surface of the image bearer, the cleaning blade dams up residual toner particles remaining on the image bearer and scrapes them off.

On the other hand, in response to a recent demand for higher image quality, the need for image forming apparatuses using a toner having a small particle size and a nearly spherical shape manufactured by a chemical method or the like has been increasing. Such a toner is more difficult to remove with a cleaning blade compared to a conventional toner manufactured by a kneading-pulverizing method. This is because the toner having a small particle size and a high sphericity slips through a slight gap formed between the cleaning blade and the image bearer.

Such slippage of toner may be prevented by increasing the contact pressure between the image bearer and the cleaning blade. However, when the contact pressure is increased, the cleaning blade may be turned up as illustrated in FIG. 1A. Further, when used in a turned-up state, the cleaning blade is locally worn as illustrated in FIG. 1B, and the leading end ridge part is finally worn as illustrated in FIG. 1C. As a result, the lifespan of the cleaning blade is shortened, and defective cleaning is likely to occur.

SUMMARY

In accordance with some embodiments of the present invention, an image forming apparatus is provided. The image forming apparatus includes: an image bearer; an electrostatic latent image forming device configured to form an electrostatic latent image on the image bearer; a visible image forming device containing a toner, configured to develop the electrostatic latent image with the toner to form a visible image; and a cleaning blade configured to remove toner particles remaining on the image bearer. The cleaning blade comprises an elastic member configured to contact a surface of the image bearer to remove the toner particles remaining on the surface of the image bearer. The elastic member comprises: a substrate; and a surface layer comprising a cured product of a curable composition. The surface layer is disposed on at least a part of a lower surface of the substrate, where the lower surface includes a contact part of the elastic member with the image bearer, and the lower surface faces a downstream side of the contact part in a direction of movement of the image bearer. The surface layer contains a siloxane compound. The surface layer has a hardness gradient in which a Martens hardness HM measured using a nanoindenter decreases from a surface of the surface layer toward the lower surface of the substrate in a thickness direction, and the Martens hardness HM measured in a region extending from a vicinity of the surface (with a load of 1 μN) to a deepest part in the thickness direction (with a load of 1,000 μN) ranges from 2.5 to 32.5 N/mm$^2$. The toner has a tensile breaking force F of from 200 to 450 gf (from 1.96 to 4.41 N), measured using a powder layer compression/tensile strength measurement device under a load of 32 kgf (313.81 N).

Hereinafter this configuration is referred to as "configuration (1)".

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1A:
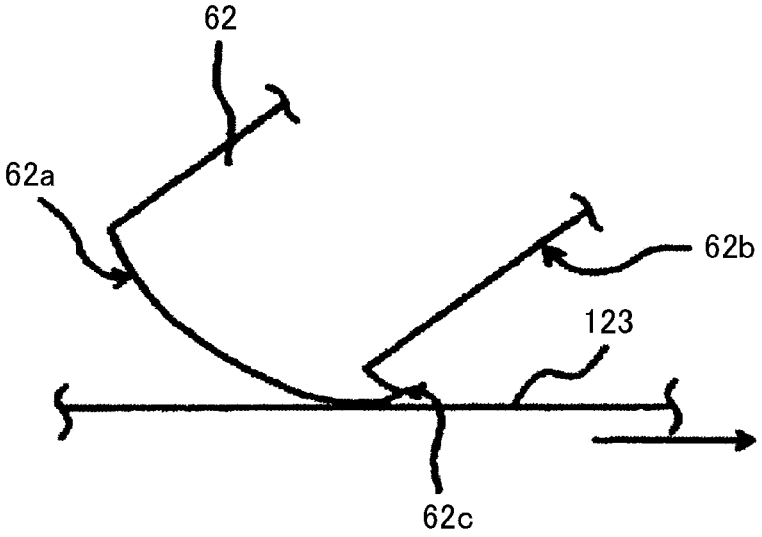
FIG. 1A RELATED ART
FIG. 1A is a diagram illustrating a state in which a leading end ridge part of a related-art cleaning blade is turned up.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In attempting to solve aforementioned problems, an elastic member made of a polyurethane elastomer has been proposed in which the contact part is provided with a surface layer made of a resin having a pencil hardness (as a film hardness) of from B to 6H.

Another cleaning blade has also been proposed which is obtained by impregnating a rubber-made elastic member with a silicone-containing ultraviolet curable composition to be swollen and irradiating it with ultraviolet rays to cure the ultraviolet-curable composition.

Another cleaning blade has also been proposed in which a part of an elastic member including the contact part is impregnated with at least one of an isocyanate compound, a fluorine compound, and a silicone compound and a surface of the elastic member including the contact part is provided with a surface layer that is harder than the elastic member.

Another cleaning blade has also been proposed which has a surface layer containing lubricating particles and a binder resin.

Generally, the surface of toner is covered with an additive comprised of, for example, inorganic particles such as silica and titanium oxide, to impart fluidity and chargeability. It is known that the additive is liberated from the toner dammed by the cleaning blade on the image bearer and supplied to the contact part between the cleaning blade and the image bearer, thus forming an accumulated layer of the additive. The accumulated layer works as a lubricant between the cleaning blade and the image bearer.

The above-described conventional techniques attempted to improve wear resistance of the cleaning blade, particularly of the leading end ridge part of the cleaning blade. However, when the additive supplied to the contact part between the cleaning blade and the image bearer slips therethrough, a part of the leading end ridge part may be chipped, or the additive may be strongly pressed against the image bearer to contaminate (or film) the image bearer and generate an abnormal image.

In recent years, there has been a demand for a higher-speed image forming apparatus. However, as the speed is increased, axial runout or fine vibration of the image bearer occurs. In this situation, the conventional cleaning blades are insufficient in ability to follow the surface of the image bearer (hereinafter "followability") and in cleaning performance at high-speed regions.

In accordance with some embodiments of the present invention, an image forming apparatus is provided in which a cleaning blade is prevented from being turned up at a leading end ridge part or being locally worn or chipped and in which an image bearer is prevented from being contaminated (filmed) with an external additive of toner, to maintain excellent cleaning performance for an extended period of time and prevent the occurrence of an abnormal image.

Hereinafter, an image forming apparatus, an image forming method, and a process cartridge according to some embodiments of the present invention are described in detail with reference to the drawings. Incidentally, it is to be noted that the following embodiments are not limiting the present invention and any deletion, addition, modification, change, etc. can be made within a scope in which person skilled in the art can conceive including other embodiments, and any of which is included within the scope of the present invention as long as the effect and feature of the present invention are demonstrated.

The cleaning blade according to an embodiment of the present invention contains a siloxane compound in the surface layer to reduce the coefficient of friction of the cleaning blade and to prevent wear of the leading end ridge part. In addition, the surface layer is given a high hardness and a hardness gradient in the thickness direction to improve followability of the cleaning blade when sliding over the image bearer, thus stabilizing the behavior of the leading end of the cleaning blade. As a result, the contact pressure of the cleaning blade against the image bearer makes the cleaning performance better than conventional technologies, the stress between the image bearer and the cleaning blade is reduced, wear of the image bearer or the cleaning blade is reduced, and the occurrence of filming of the additive of toner is prevented.

When the Martens hardness HM measured in a region extending from the vicinity of the surface (with a load of 1 μN) to the deepest part in the thickness direction (with a load of 1,000 μN) in the surface layer ranges from 2.5 to 32.5 $N/mm^2$, the cleaning blade effectively dams up the toner and the additive liberated from the toner to ensure good filming resistance and cleaning performance. When the Martens hardness HM is smaller than 2.5 $N/mm^2$, the blade is insufficient in hardness and the ability to dam up the toner is reduced, thereby causing filming and defective cleaning. When the Martens hardness HM is higher than 32.5 $N/m^2$, in a case in which the additive supplied to the contact part between the cleaning blade and the image bearer slips therethrough, a part of the leading end ridge part may be chipped, or the additive may be strongly pressed against the image bearer to cause filming on the image bearer and generate an abnormal image.

Further, one feature of the toner according to an embodiment of the present invention is a high adhesive force between toner particles when compressed. The adhesive force is represented by a tensile breaking force F. The tensile breaking force F of the toner according to an embodiment of the present invention measured using a powder layer compression/tensile strength measurement device under a load of 32 kgf (313.81 N) is from 200 to 450 gf (from 1.96 to 4.41 N). When the cleaning blade according to an embodiment of the present invention is used for a toner having a tensile breaking force F within the above-described range, the toner dammed up by the cleaning blade forms a stable accumulated layer, and the toner enters into the contact part between the cleaning blade and the image bearer without slipping therethrough. This leads to improvement of cleaning performance. In addition, the additive such as silica and titanium oxide contained in the toner is less likely to be liberated and supplied to the contact part, thus preventing the occurrence of filming.

Details for the method of measuring the tensile breaking force F is described later.

The effects of the present invention can be further enhanced by the following configurations (2) to (9).

(2) The image forming apparatus according to configuration (1), wherein the curable composition comprises a polyurethane compound.

(3) The image forming apparatus according to configuration (1) or (2), wherein the siloxane compound comprises a modified silicone oil.

(4) The image forming apparatus according to any one of configurations (1) to (3), wherein the surface layer has an average thickness of from 10 to 500 μm.

(5) The image forming apparatus according to any one of configurations (1) to (4), wherein the surface layer has a gradient in creep property (CIT) in which the creep property (CIT) measured using the nanoindenter decreases from the surface of the surface layer toward the lower surface of the substrate, and the creep property (CIT) measured in a region extending from the vicinity of the surface (with a load of 1 μN) to the deepest part in the thickness direction (with a load of 1,000 μN) ranges from 3.0% to 13.5%.

(6) The image forming apparatus according to anyone of configurations (1) to (5), wherein the surface layer is disposed over a region extending from the contact part for a distance of at least 1 mm in a surface direction of the lower surface of the substrate.

(7) The image forming apparatus according to any one of configurations (1) to (6), wherein the toner contains a crystalline resin, and a presence ratio of the crystalline resin at the surface of the toner is from 15% to 60% by mass, measured by an ATR (Attenuated Total Reflection) method using a Fourier transform infrared spectrometer (FT-IR).

(8) An image forming method comprising the steps of: forming an electrostatic latent image on an image bearer; developing the electrostatic latent image with a toner to form a visible image; and removing toner particles remaining on the image bearer with a cleaning blade, wherein the cleaning blade comprises an elastic member configured to contact a surface of the image bearer to remove the toner particles remaining on the surface of the image bearer, the elastic member comprising: a substrate; and a surface layer comprising a cured product of a curable composition, wherein the surface layer is disposed on at least a part of a lower surface of the substrate, where the lower surface includes a contact part of the elastic member with the image bearer, and the lower surface faces a downstream side of the contact part in a direction of movement of the image bearer, wherein the surface layer contains a siloxane compound, wherein the surface layer has a hardness gradient in which a Martens hardness HM measured using a nanoindenter decreases from a surface of the surface layer toward the lower surface of the substrate in a thickness direction, and the Martens hardness HM measured in a region extending from a vicinity of the surface (with a load of 1 μN) to a deepest part in the thickness direction (with a load of 1,000 μN) ranges from 2.5 to 32.5 $N/mm^2$, wherein the toner has a tensile breaking force F of from 200 to 450 gf (from 1.96 to 4.41 N), measured using a powder layer compression/tensile strength measurement device under a load of 32 kgf (313.81 N).

(9) A process cartridge comprising the image forming apparatus according to any one of configurations 1 to 7.

Cleaning Blade

Figure 1B:
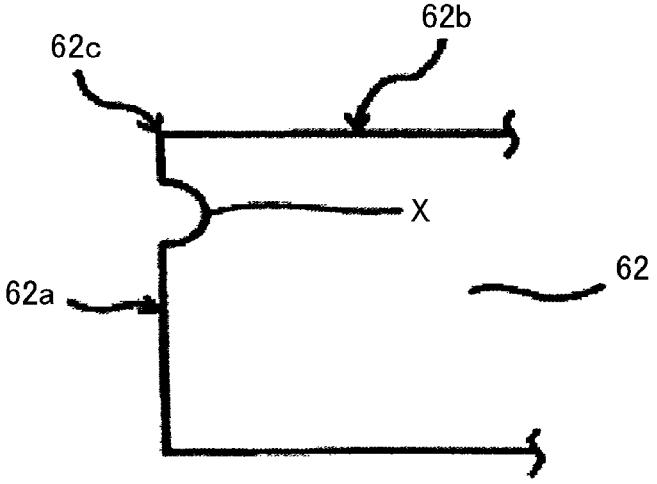
FIG. 1B RELATED ART
FIG. 1B is a diagram illustrating a state in which a leading end surface of a related-art cleaning blade is locally worn.
Figure 1C:
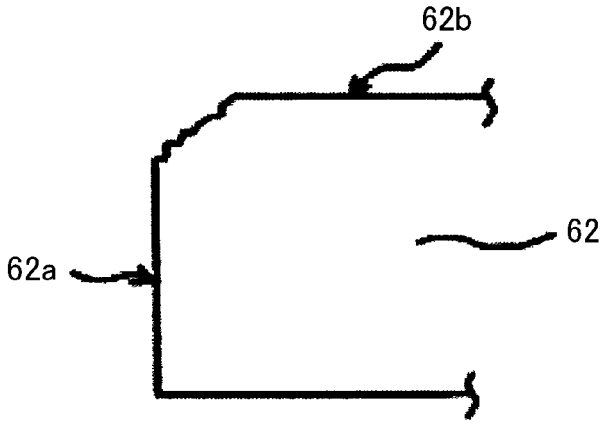
FIG. 1C RELATED ART
FIG. 1C is a diagram illustrating a state in which a leading end ridge part of a related-art cleaning blade is missing.

One method of improving the cleaning performance of a cleaning blade (hereinafter may be simply referred to as "blade") involves increasing the contact pressure between the image bearer and the cleaning blade. However, when the contact pressure of the cleaning blade is increased, as illustrated in FIG. 1A, the frictional force between an image bearer 123 and a cleaning blade 62 increases, and the cleaning blade 62 is pulled in the direction of movement of the image bearer 123. As a result, a leading end ridge part 62*c* of the cleaning blade 62 is turned up. If a cleaning operation is continued while the leading end ridge part 62*c* of the cleaning blade 62 is turned up, as illustrated in FIG. 1B, a local wear X occurs at a position several micrometers away from the leading end ridge part 62*c* of a blade leading end surface 62*a* of the cleaning blade 62. If the cleaning operation is further continued in such a state, the local wear becomes large, and eventually, as illustrated in FIG. 1C, the leading end ridge part 62*c* is worn out and becomes missing. If the leading end ridge part 62*c* becomes missing in this manner, the cleaning blade is not able to properly remove toner, resulting in defective cleaning. In FIGS. 1A to 1C, a reference sign 62*b* denotes a lower surface of the cleaning blade.

On the other hand, the cleaning blade according to an embodiment of the present invention includes an elastic member configured to contact a surface of the image bearer to remove toner particles remaining on the image bearer. The elastic member includes a substrate and a surface layer comprising a cured product of a curable composition. The surface layer is disposed on at least a part of a lower surface of the substrate, where the lower surface includes a contact part of the elastic member with the image bearer and faces a downstream side of the contact part in a direction of movement of the image bearer. The surface layer further contains a siloxane compound. The surface layer has a hardness gradient in which the Martens hardness HM measured using a nanoindenter decreases from a surface of the surface layer toward the lower surface of the substrate in the thickness direction. Specifically, the hardness gradient is grasped from the hardness in the vicinity of the surface of the surface layer, the hardness at the deepest part in the thickness direction, and the hardness at the intermediate part of the surface layer. The hardness in the vicinity of the surface of the surface layer is acquired by measuring the Martens hardness HM(1) with a load of 1 μN, the hardness at the deepest part in the thickness direction is acquired by measuring the Martens hardness HM(1000) with a load of 1,000 μN, and the hardness at the intermediate part of the surface layer is acquired by measuring the Martens hardness HM(50) with a load of 50 μN.

Figure 2:
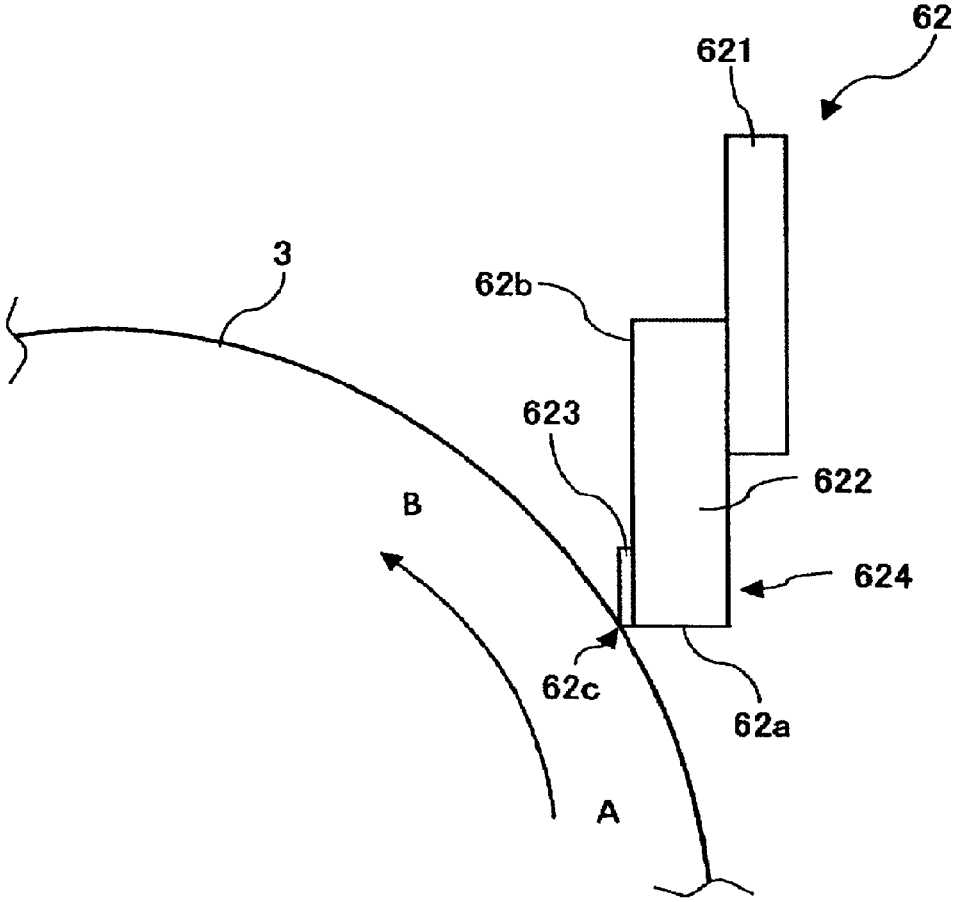
FIG. 2 is an enlarged cross-sectional diagram illustrating a state in which a cleaning blade according to an embodiment of the present invention is in contact with a surface of an image bearer.
Figure 3:
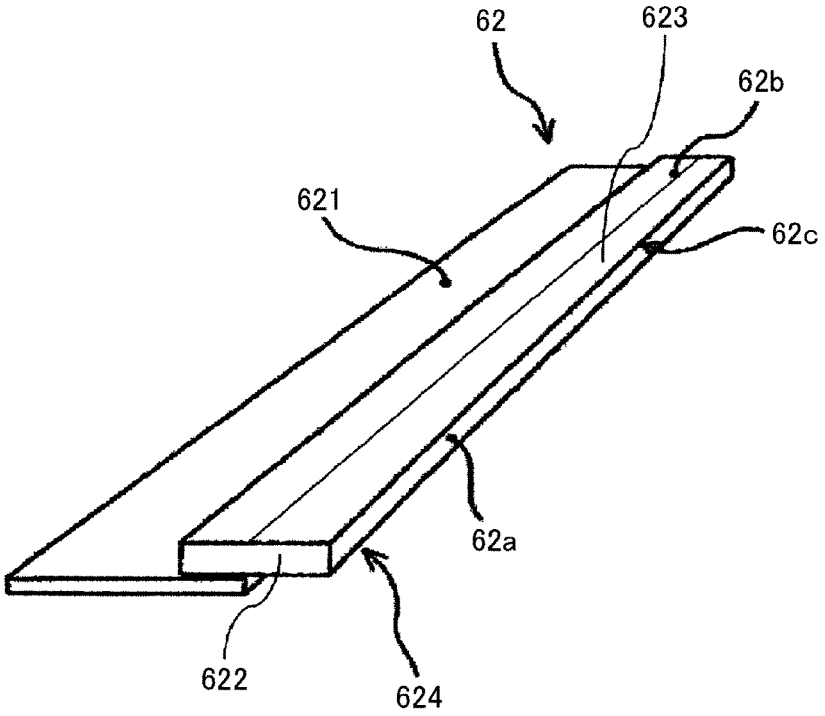
FIG. 3 is a perspective view of a cleaning blade according to an embodiment of the present invention.

The cleaning blade according to an embodiment of the present invention is described in detail below with reference to FIGS. 2 and 3. FIG. 2 is a diagram illustrating a state in which the cleaning blade 62 is in contact with a surface of a photoconductor 3. FIG. 3 is a perspective view of the cleaning blade 62. As illustrated, the cleaning blade 62 includes a support 621, an elastic member 624, a substrate 622, and a surface layer 623. The substrate 622 has a strip-like shape. The blade leading end surface 62*a*, the blade lower surface 62*b*, and the leading end ridge part 62*c* (also referred to as "contact part" or "edge part") are also illustrated.

In the present disclosure, a surface of the substrate constituting the elastic member in the longitudinal direction which faces downstream in the direction of movement (i.e., direction of rotation, in the present embodiment) of the image bearer is referred to as the lower surface of the substrate. An end surface of the substrate which includes the leading end ridge part and faces upstream in the direction of rotation of the image bearer is referred to as the leading end surface of the substrate. In addition, a surface of the elastic member in the longitudinal direction which faces downstream in the direction of rotation of the image bearer is referred to as the lower surface of the blade. An end surface of the elastic member which includes the leading end ridge part and faces upstream in the direction of rotation of the image bearer is referred to as the leading end surface of the blade.

In FIG. 2, the surface 62*b* that faces a downstream side B in the direction of movement of the image bearer is the lower surface of the blade, and the end surface 62*a* that faces an upstream side A in the direction of movement of the image bearer is the leading end surface of the blade. The contact part of the elastic member that contacts the surface of the image bearer includes the leading end ridge part of the elastic member. When the leading end ridge part is turned up or when the linear pressure is high, a part of the leading end surface of the blade can also be included in the contact part.

Method for Manufacturing Cleaning Blade

Conventionally, a blade has been manufactured by spray or dip coating, which is difficult to make the surface layer thick at the contact part. Even in the case of making the thickness of the surface layer in the vicinity of the contact part 10 μm, the thickness of the surface layer at the contact part becomes less than 1 to 3 μm. In such a case, the contact part is rounded, and the edge accuracy is poor. This may result in poor cleaning performance.

As one example of conventional techniques, JP-5515865-B (corresponding to JP-2011-185984-A) discloses a method for manufacturing a cleaning blade in which a sheet material made of a long polyurethane rubber is impregnated with an impregnating agent, cut, and coated with a resin-containing coating agent, and the coating agent is cured to form a coating film. In this method, since the coating film is applied later, the thickness of the edge part may be reduced, and the torque may increase with time. Further, JP-2962843-B (corresponding to JP-H04-212190-A) discloses a cleaning blade having a coating layer containing lubricating particles, in which an edge is cut after the formation of the coating layer. However, since the lubricating particles are dispersed in the coating layer, the coating layer has a large surface roughness, and the edge accuracy is poor although the edge is cut after the formation of the coating layer, which may result in poor cleaning performance.

By contrast, the cleaning blade 62 of the present embodiment is prepared by coating the substrate 622 made of, for example, urethane rubber with a curable composition and curing the composition by heat to form the surface layer 623. After that, the contact part is cut into a blade shape. The surface layer 623 contains a siloxane compound and has a hardness gradient in which the hardness decreases from the surface of the surface layer toward the lower surface of the substrate in the thickness direction. The surface layer 623 is formed by coating at least the leading end ridge part 62*c* of the cleaning blade 62 with a curable composition by means of spray coating, dip coating, die coating, or the like.

The surface layer on the lower surface of the substrate can be formed by bar coating, spray coating, dip coating, brush coating, screen printing, or the like. The thickness of the surface layer can be controlled by changing the solid content concentration of the coating liquid, coating conditions (e.g., the gap in bar coating; the discharge amount, distance, and moving speed in spray coating; the pulling speed in dip coating), the number of times of coating, and the like.

Figure 4A:
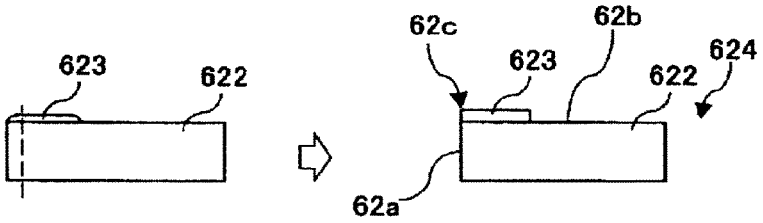
FIGS. 4A and 4B are diagrams each illustrating a method for manufacturing a cleaning blade according to an embodiment of the present invention.
Figure 4B:
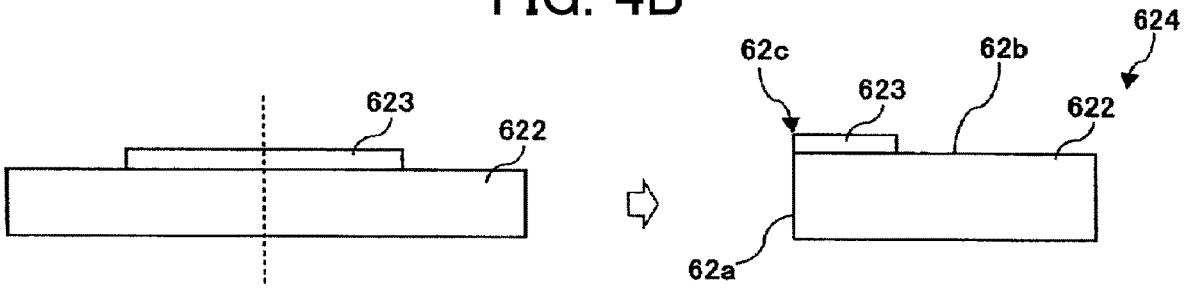

FIGS. 4A and 4B are diagrams illustrating a part of the method for manufacturing the cleaning blade according to the present embodiment. FIGS. 4A and 4B are diagrams in which the elastic member of the cleaning blade is viewed from a side surface. On the left side in FIG. 4A, the substrate 622 to which the curable composition has been applied and cured is illustrated. An end surface of the substrate 622 is then cut off along the broken line to prepare the elastic member 624 illustrated on the right side in FIG. 4A. The position to be cut can be changed as appropriate. For example, the substrate 622 can be cut at a position 1 mm away from the leading end thereof.

Another example is illustrated in FIG. 4B. On the left side in FIG. 4B, the substrate 622 to which the curable composition has been applied and cured is illustrated, as in FIG. 4A. Here, the substrate 622 is cut near the central part, instead of cutting off an end surface of the substrate 622 as in FIG. 4A. In this case, it is possible to prepare two cleaning blades at the same time.

As another example, a method in which the curable composition is cured using a mold to form a right-angled contact part may also be employed.

The method of cutting the substrate 622 and the surface layer 623 is not particularly limited and can be selected as appropriate. For example, a vertical slicer may be used for the cutting. The direction of cutting is not particularly limited and can be selected as appropriate. Preferably, the cutting is performed from the surface layer 623 side toward the substrate 622 side. In this case, the edge accuracy is improved.

In the present embodiment, after a thick film of the surface layer 623 is formed on the lower surface of the substrate, the edge is cut. By this procedure, a thick film and edge accuracy are both achieved at the contact part.

Image Bearer

The material, shape, structure, size, and the like of the image bearer are not particularly limited and can be suitably selected to suit to a particular application. Examples of the shape of the image bearer include, but are not limited to, a drum shape, a belt shape, a flat plate shape, and a sheet shape. The size of the image bearer is not particularly limited and can be suitably selected to suit to a particular application. Preferably, the image bearer is in a size that is generally used. The material of the image bearer is not particularly limited and can be suitably selected to suit to a particular application. Examples thereof include, but are not limited to, metals, plastics, and ceramics.

Support

Preferably, the cleaning blade of the present embodiment includes a support and an elastic member in a flat plate shape, and one end of the elastic member is connected to the support and the other end has a free end portion having a specific length. The cleaning blade is disposed in such a manner that the contact part including the leading end ridge part, which corresponds to one end of the elastic member which has the free end portion, comes into contact with a surface of a member to be cleaned along a longitudinal direction.

The shape, size, material, and the like of the support are not particularly limited and can be suitably selected to suit to a particular application. Examples of the shape of the support include, but are not limited to, a plate shape, a strip shape, and a sheet shape. The size of the support is not particularly limited and can be suitably selected according to the size of the member to be cleaned.

Examples of the material of the support include, but are not limited to, metals, plastics, and ceramics. Among these, metal plates are preferred for their strength, and steel plates (e.g., stainless steel plates), aluminum plates, and phosphor bronze plates are particularly preferable.

Substrate

The shape, material, size, structure, and the like of the substrate 622 of the elastic member 624 are not particularly limited and can be suitably selected to suit to a particular application.

Examples of the shape include, but are not limited to, a plate shape, a strip shape, and a sheet shape.

The size is not particularly limited and can be suitably selected according to the size of the member to be cleaned.

The material is not particularly limited and can be suitably selected to suit to a particular application. Preferred examples thereof include polyurethane rubber and polyurethane elastomer because they can easily achieve high elasticity.

The method for manufacturing the substrate of the elastic member is not particularly limited and can be suitably selected to suit to a particular application. For example, the substrate can be manufactured as follows. First, a polyurethane prepolymer is prepared from a polyol compound and a polyisocyanate compound, then a curing agent is added thereto, optionally along with a curing catalyst, to cause a cross-linking reaction in a predetermined mold. Next, the product is post-cross-linked in a furnace, formed into a sheet by centrifugal molding, left at room temperature for aging, and cut into a flat plate having a predetermined size.

The polyol compound is not particularly limited and can be suitably selected to suit to a particular application. Examples thereof include, but are not limited to, high-molecular-weight polyols and low-molecular-weight polyols.

Examples of the high-molecular-weight polyols include, but are not limited to, a polyester polyol that is a condensate of an alkylene glycol and an aliphatic diprotic acid; polyester-based polyols, such as polyester polyols of alkylene glycols with adipic acid, such as ethylene adipate ester polyol, butylene adipate ester polyol, hexylene adipate ester polyol, ethylene propylene adipate ester polyol, ethylene butylene adipate ester polyol, and ethylene neopentylene adipate ester polyol; polycaprolactone-based polyols such as polycaprolactone ester polyols obtained by ring-opening polymerization of caprolactone; and polyether-based polyols such as poly(oxytetramethylene) glycol and poly(oxypropylene) glycol. Each of these can be used alone or in combination with others.

Examples of the low-molecular-weight polyols include, but are not limited to, divalent alcohols such as 1,4-butanediol, ethylene glycol, neopentyl glycol, hydroquinone-bis(2-hydroxyethyl) ether, 3,3'-dichloro-4,4'-diaminodiphenylmethane, and 4,4'-diaminodiphenylmethane; and trivalent or higher polyvalent alcohols such as 1,1,1-trimethylolpropane, glycerin, 1,2,6-hexanetriol, 1,2,4-butanetriol, trimethylolethane, 1,1,1-tris(hydroxyethoxymethyl)propane, diglycerin, and pentaerythritol. Each of these can be used alone or in combination with others.

The polyisocyanate compound is not particularly limited and can be suitably selected to suit to a particular application. Examples thereof include, but are not limited to, methylene diphenyl diisocyanate (MDI), tolylene diisocyanate (TDI), xylylene diisocyanate (XDI), naphthylene 1,5-diisocyanate (NDI), tetramethylxylene diisocyanate (TMXDI), isophorone diisocyanate (IPDT), hydrogenated xylylene diisocyanate (H6XDT), dicyclohexylmethane diisocyanate (H12MDI), hexamethylene diisocyanate (HDI), dimer acid diisocyanate (DDI), norbornene diisocyanate (NBDI), and trimethylhexamethylene diisocyanate (TMDI). Each of these can be used alone or in combination with others.

The curing catalyst is not particularly limited and can be suitably selected to suit to a particular application. Examples thereof include, but are not limited to, amine compounds such as tertiary amines and organometallic compounds such as organotin compounds.

Examples of the tertiary amines include, but are not limited to, trialkylamines such as triethylamine, tetraalkyldiamines such as N,N,N',N'-tetramethyl-1,3-butanediamine, amino alcohols such as dimethylethanolamine, ester amines such as ethoxylated amine, ethoxylated diamine, and bis(diethylethanolamine) adipate, cyclohexylamine derivatives such as triethylenediamine (TEDA) and N,N-dimethylcyclohexylamine, morpholine derivatives such as N-methylmorpholine, N-(2-hydroxypropyl)-dimethylmorpholine, and piperazine derivatives such as N,N'-diethyl-2-methylpiperazine and N,N'-bis-(2-hydroxypropyl)-2-methylpiperazine. Examples of the organotin compounds include, but are not limited to, dialkyltin compounds such as dibutyltin dilaurate and dibutyltin di(2-ethylhexoate), stannous 2-ethylcaproate, and stannous oleate. Each of these can be used alone or in combination with others.

The proportion of the curing catalyst to the polyurethane prepolymer is not particularly limited and can be suitably selected to suit to a particular application, but is preferably from 0.01% to 0.5% by mass, more preferably from 0.05% to 0.3% by mass.

The JIS-A hardness of the substrate is not particularly limited and can be suitably selected to suit to a particular application, but is preferably 60 degrees or more, more preferably from 65 degrees to 80 degrees. When the JIS-A hardness is 60 degrees or more, the linear pressure of the blade is appropriate, and the area of the contact part with the image bearer is less likely to be enlarged, so that defective cleaning hardly occurs.

The JTS-A hardness of the substrate can be measured using, for example, a micro durometer MD-1 available from Kobunshi Keiki Co., Ltd.

The rebound resilience of the substrate in accordance with JIS (Japanese Industrial Standards) K6255 is not particularly limited and can be suitably selected to suit to a particular application. The rebound resilience of the substrate can be measured using, for example, a resilience tester No. 221 available from Toyo Seiki Seisaku-sho, Ltd. according to JIS K6255 at 23 degrees C.

The average thickness of the substrate is not particularly limited and can be suitably selected to suit to a particular application, but is preferably from 1.0 to 3.0 mm.

The Martens hardness of the substrate is not particularly limited and can be suitably selected to suit to a particular application. Preferably, the Martens hardness of the substrate is from 0.8 to 3.0 N/mm$^2$. When the Martens hardness of the substrate is from 0.8 to 3.0 N/mm$^2$, the surface layer having a thickness of 10 μm or more is prevented from being cracked, and defective cleaning hardly occurs even after a long-term use. Further, when the Martens hardness of the substrate is 0.8 N/mm$^2$ or more, the substrate is not too soft, and the image bearer is prevented from being deformed by vibration caused by axial runout, etc. In addition, the surface layer can easily follow the deformation of the substrate and is prevented from being cracked, leading to good cleaning performance.

The Martens hardness (HM) of the substrate is measured using a nanoindentation method as follows. The Martens hardness (HM) is measured according to ISO 14577 using a nanoindenter ENT-3100 available from ELIONIX INC. by pushing a Berkovich indenter into a sample with a load of 1,000 μN for 10 seconds, holding for 5 seconds, and pulling the indenter with the same loading rate for 10 seconds. The measurement position is 100 μm away from the leading end ridge part of the leading end surface of the blade.

Figure 5:
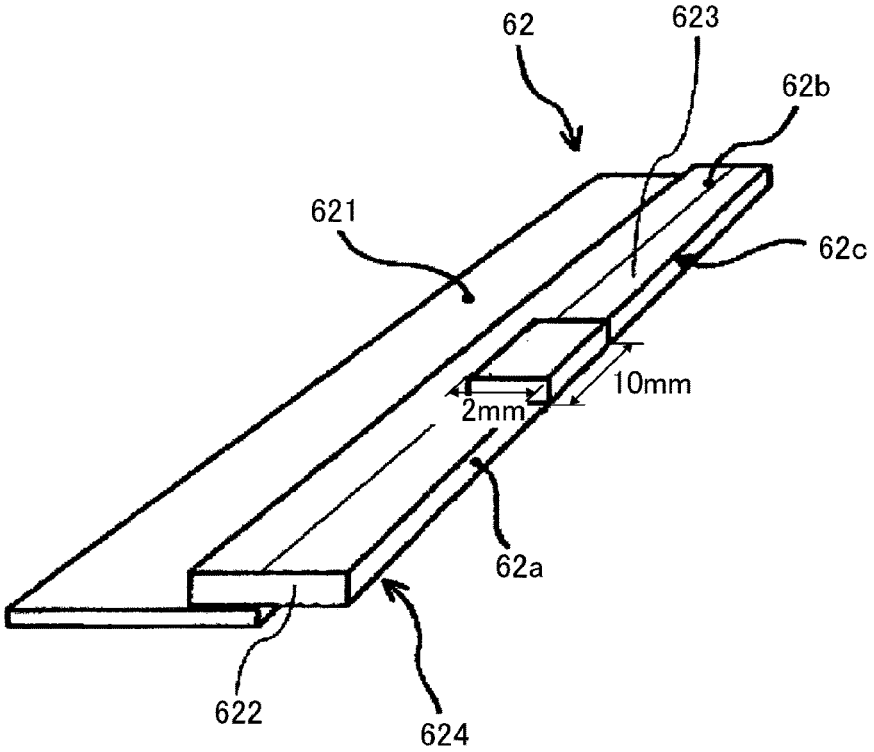
FIG. 5 is a diagram for explaining a cut portion of a substrate for measuring the Martens hardness (HM) of the substrate.
Figure 6A:
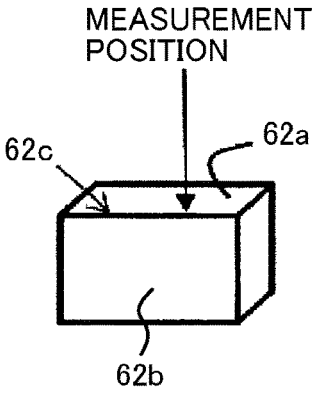
FIGS. 6A to 6C are diagrams for explaining measurement positions for the Martens hardness (HM) of the substrate.
Figure 6B:
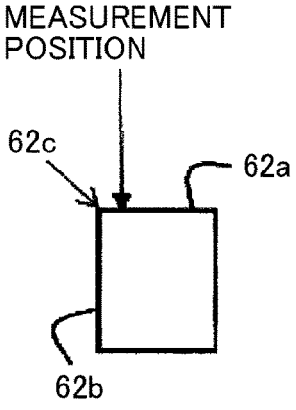
Figure 6C:
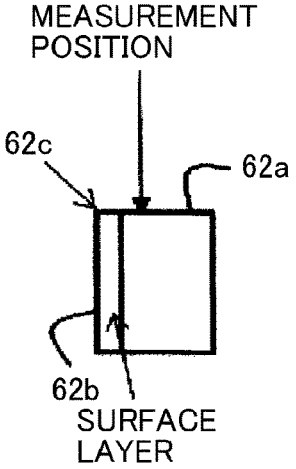

In the measurement, as illustrated in FIG. 5, the substrate 622 is cut into a rectangle with a side having a length of 2 mm from the blade leading end surface 62*a* in a lateral direction of the substrate 622 (i.e., direction orthogonal to the longitudinal direction of the substrate 622) and another side with a length of 10 mm in the longitudinal direction. After that, as illustrated in a perspective view of the substrate in FIG. 6A and a front view of the substrate in FIG. 6B, the cut substrate is fixed to a slide glass with an adhesive or double-sided tape such that the blade leading end surface 62*a* faces upward. The Martens hardness (HM) is measured at a measurement position that is 100 μm away from the leading end ridge part 62*c* in the lateral direction. Even when the surface layer is formed on the lower surface of the substrate as illustrated in FIG. 6C, the Martens hardness (HM) can be measured in the same manner. Alternatively, the Martens hardness (HM) can be measured by cutting the surface layer with a razor or the like to expose the leading end surface of the substrate. The Martens hardness (HM) of the surface layer 623 described below is measured in the above-described manner, by cutting the substrate having the surface layer formed on the lower surface as illustrated in FIG. 6C and fixing it on a slide glass with an adhesive or double-sided tape such that the surface layer 623 faces upward.

Surface Layer

In the cleaning blade of the present embodiment, the leading end ridge part 62*c* that contacts the image bearer is formed of the surface layer 623. The surface layer 623 is formed of a curable composition described below and is not a mixed layer with the elastic member. The surface layer 623 is formed on the contact part and the lower surface of the substrate and may also be formed on the blade leading end surface 62*a*. Further, the curable composition may be contained inside the elastic member.

The surface layer 623 may cover the entire surface of the substrate. Preferably, the surface layer 623 is formed over a region extending from the contact part for a distance of at least 1 mm, preferably from 1 to 7 mm, in the surface direction of the lower surface of the substrate. When the region is extending for a distance of 7 mm or less, the flexibility of the elastic member is not impaired, the followability with respect to the photoconductor is improved, and the cleaning performance is improved.

The surface layer 623 is not particularly limited and can be suitably selected to suit to a particular application. Preferably, the Martens hardness of the cured product is higher than that of the substrate. When the surface layer 623 is made of a material having a higher hardness than the substrate 622 of the elastic member 624, the surface layer 623 is rigid and thus hardly deformed, so that the leading end ridge part 62*c* of the cleaning blade 62 is prevented from being turned up.

The method of curing the curable composition for forming the surface layer on the contact part of the cleaning blade is not particularly limited and can be suitably selected to suit to a particular application. Examples thereof include a heat treatment.

Preferably, the cleaning blade has an elastic power of from 60% to 90%. The elastic power is a characteristic value obtained from the integrated stress at the time of measuring the Martens hardness as follows. The Martens hardness is measured using a microhardness tester, for example, by an operation in which a Berkovich indenter is pushed with a constant force for 30 seconds, held for 5 seconds, and pulled with a constant force for 30 seconds.

Figure 7:
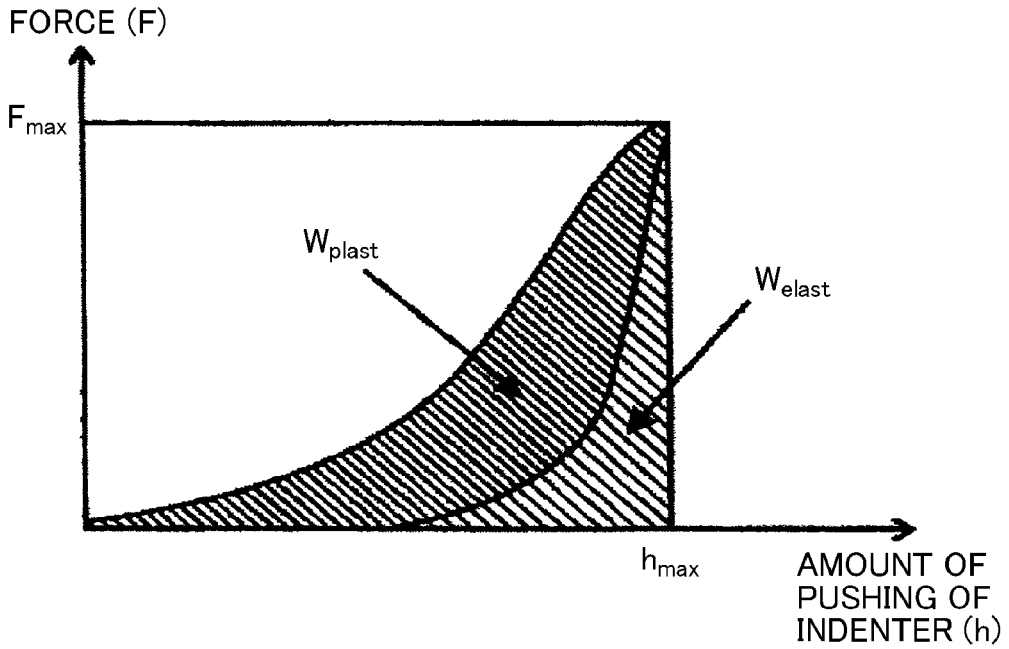
FIG. 7 is an explanatory diagram of elastic power.

Here, the elastic power is a characteristic value defined by the equation Welast/Wplast×100 [%], where Wplast is an integrated stress when the Berkovich indenter is pushed and Welast is an integrated stress when the test load is unloaded (See FIG. 7). The higher the elastic power, the less the plastic deformation, that is, the higher the rubber property. When the elastic power is 60% or more, the movement of the contact part is not inhibited, and the wear resistance is improved.

In the present disclosure, the average thickness of the surface layer is preferably from 10 to 500 μm, more preferably from 50 to 200 μm. When the average thickness is within this range, the flexibility of the substrate of the elastic member is maintained, and the occurrence of axial runout or fine vibration of the image bearer due to speeding up of the image forming apparatus is prevented. In addition, the ability to follow minute undulations on the surface of the image bearer is improved, and the cleaning performance is improved. Further, when the average thickness is 10 μm or more, abnormal noise due to abnormal wear or the like is prevented.

Here, the average thickness of the surface layer at the contact part is the arithmetic average value of thickness values measured at 10 randomly-selected points of the surface layer at the contact part. The method of measuring the thickness is not particularly limited and can be suitably selected to suit to a particular application. For example, the thickness may be measured by observing the cut surface of the surface layer at the contact part using a microscope. Specifically, for example, the thickness of the surface layer at a position 50 to 200 μm away from the leading end of the contact part (contact side) is measured. In addition, the measurement is usually performed at a position that is not within a region extending from each end for a distance of 2 cm in the longitudinal direction (direction of the contact side).

Curable Composition

The curable composition is a material in which monomers or oligomers are polymerized by receiving energy such as light and heat and cured to form a cured product (solid polymer). The energy source varies depending on the type of initiator or stimulus (electron beam) that generates active species (e.g., radical, ion, acid, base) for initiating polymerization. Examples of the curable composition include, but are not limited to, ultraviolet curable compositions, heat curable compositions, electron beam curable compositions.

For polymerization of the ultraviolet curable compositions or electron beam curable compositions, a photopolymerization initiator is used. Upon irradiation with ultraviolet rays or an electron beam, a curing reaction occurs that is classified into any of radical polymerization, cationic polymerization, and anionic polymerization. A cured product is formed through a polymerization reaction such as vinyl polymerization, vinyl copolymerization, ring-opening polymerization, and addition polymerization.

For polymerization of the heat curable compositions, a thermal polymerization initiator is used. A curing reaction starts upon application of heat. A cured product is formed through a polymerization reaction such as addition polymerization of isocyanate group with hydroxyl group, radical polymerization, epoxy ring-opening polymerization, and melamine-based condensation.

The cured product formed by such a reaction is not particularly limited and can be suitably selected to suit to a particular application. Examples thereof include, but are not limited to, acrylic resins, phenol resins, urethane resins, epoxy resins, silicone resins, amino resins, and resin compositions having a polyethylene backbone. In particular, polyurethane compounds such as urethane resins are preferred for their excellent wear resistance, excellent compatibility with and adhesion to urethane rubber of the substrate, and ease of adjusting physical properties such as hardness and elastic power by controlling NCO groups and OH groups.

The urethane resins are not particularly limited and can be suitably selected to suit to a particular application. Preferred examples thereof include those obtained from a combination of a prepolymer having NCO groups at both terminals and a curing agent (a compound having $NH_2$ group or OH group). Preferred examples of the prepolymer having NCO groups at both terminals include a prepolymer obtained by binding a polyfunctional isocyanate to both terminals of PTMG (polytetramethylene ether glycol).

The polyfunctional polyisocyanate for preparing the prepolymer is not particularly limited and can be suitably selected to suit to a particular application. Examples thereof include, but are not limited to, methylene diphenyl diisocyanate (MDI), tolylene diisocyanate (TDI), xylylene diisocyanate (XDI), naphthylene 1,5-diisocyanate (NDI), tetramethylxylene diisocyanate (TMXDI), isophorone diisocyanate (IPDI), hydrogenated xylylene diisocyanate (H6XDI), dicyclohexylmethane diisocyanate (H12MDI), hexamethylene diisocyanate (HDI), dimer acid diisocyanate (DDI), norbornene diisocyanate (NBDI), and trimethylhexamethylene diisocyanate (TMDT). Each of these may be used in combination with PTMG or may be used after being made into a nurate body.

Examples of the curing agent include, but are not limited to, compounds reactive with the prepolymer, such as diols, triols, diamines, and triamines. Examples of the curing agent further include trimethylolpropane (TMP) and diaminodiphenylmethane (DDM). Each of these can be used alone or in combination with others.

The degree of polymerization of PTMG in the prepolymer is not particularly limited and can be suitably selected to suit to a particular application.

In the present disclosure, the surface layer has a hardness gradient in which the hardness decreases from the surface of the surface layer toward the lower surface of the substrate in the thickness direction. Such a hardness gradient can be formed as follows. The hardness of the surface layer can be increased by increasing the cross-linking density. This can be achieved by designing the equivalent ratio (equivalent of NCO groups in the prepolymer/equivalent of $NH_2$ groups and OH groups in the curing agent) in the curable composition higher than 1 and increasing the number of isocyanurate bonds in the curable composition using excessive NCO groups. If the number of isocyanurate bonds is increased uniformly throughout the curable composition, the entire of the cured product may become too hard to be brittle. Therefore, in the present disclosure, it is preferable that the amount of isocyanurate bonds in the curable composition on the side of the surface of the surface layer be larger than the amount of isocyanurate bonds on the side of the lower surface of the substrate. By forming the surface layer in this manner, a hardness gradient is formed in which the hardness decreases from the surface of the surface layer toward the lower surface of the substrate in the film thickness direction. The hardness of the surface layer on the side of the lower surface of the substrate becomes close to the hardness of the substrate that is soft, and the blade qualities such as followability are stabilized. The amount of isocyanurate bonds in the curable composition on the side of the surface of the surface layer can be increased by, for example, applying the curable composition to the substrate, then leaving it in a high-temperature high-humidity environment of, for example, 45 degrees C. and 90% RH for several days to complete the reaction of excessive NCO groups, thus proceeding cyanuration on the side of the surface of the surface layer more than the side of the lower surface of the substrate.

The siloxane compound in the surface layer can be suitably selected to suit to a particular application. Preferred examples thereof include a modified silicone oil. When the modified silicone oil is used, the coefficient of friction of the blade is reduced, the frictional force during sliding is reduced to prevent wear of the blade, and the behavior of the leading end of the blade during sliding is stabilized. In the case of using a polyurethane compound, because the polyurethane compound is generally hard, the use of the modified silicone oil promotes stabilization of the behavior of the leading end of the blade.

The coefficient of friction of the blade can be measured as a coefficient of kinetic friction (μK), and is preferably 1.2 or less, more preferably 0.5 or less.

Examples of the modified silicone oil include, but are not limited to, polyether-modified silicone oils and alkyl-modified silicone oils. Commercially available products thereof include, but are not limited to, SH8400 (polyether-modified silicone oil available from Dow Corning Toray Co., Ltd.), FZ-2110 (polyether-modified silicone oil available from Dow Corning Toray Co., Ltd.), SF8416 (alkyl-modified silicone oil available from Dow Corning Toray Co., Ltd.), SH3773M (polyether-modified silicone oil available from Dow Corning Toray Co., Ltd.), and Shin-Etsu Silicone X-22-4272 (polyether-modified silicone oil available from Shin-Etsu Chemical Co., Ltd.).

The proportion of the siloxane compound in the surface layer is, for example, 8% to 15% by mass, and preferably 8% to 10% by mass.

For improving the effect of the present invention, it is preferable that the surface layer of the present disclosure have a hardness gradient in which the Martens hardness HM measured using a nanoindenter decreases from the surface of the surface layer toward the lower surface of the substrate in the thickness direction. The Martens hardness HM can be measured using the same instrument used for measuring the Martens hardness of the substrate. The Martens hardness HM is measured at, at least, the following two positions: the vicinity of the surface of the surface layer and the deepest part in the thickness direction. Preferably, the Martens hardness HM is further measured at an intermediate part therebetween. The Martens hardness HM of the surface layer can be measured in the same manner as the Martens hardness HM of the substrate. The "Martens hardness HM(1) in the vicinity of the surface of the surface layer" is measured by pushing a Berkovich indenter into the surface layer with a load of 1 μN for 10 seconds, holding for 5 seconds, and pulling up the indenter with the same load for 10 seconds. Similarly, the "Martens hardness HM(1000) at the deepest part in the thickness direction of the surface layer" is measured by pushing a Berkovich indenter into the surface layer with a load of 1,000 μN for 10 seconds, holding for 5 seconds, and pulling up the indenter with the same load for 10 seconds. Further, the "Martens hardness HM(50) at the intermediate part" is measured by pushing a Berkovich indenter into the surface layer with a load of 50 μN for 10 seconds, holding for 5 seconds, and pulling up the indenter with the same load for 10 seconds.

In the present disclosure, the Martens hardness HM of the surface layer is preferably in the range of from 2.5 to 32.5 $N/m^2$, more preferably from 4.0 to 21.0 $N/m^2$, when the load ranges from 1 to 1,000 μN. Specifically, the Martens hardness HM(1) in the vicinity of the surface of the surface layer is preferably from 7.5 to 32.5 $N/mm^2$, and more preferably from 17.0 to 21.0 $N/mm^2$. The Martens hardness HM(1000) at the deepest part in the thickness direction of the surface layer is preferably from 2.5 to 9.5 $N/mm^2$, and more preferably from 3.5 to 5.0 $N/mm^2$. The Martens hardness HM(50) at the intermediate part of the surface layer is preferably from 4.0 to 18.0 $N/mm^2$, and more preferably from 7.0 to 12.0 $N/mm^2$.

Further, for improving the effect of the present invention, it is preferable that the surface layer of the present disclosure have a gradient in creep property (CIT) in which the creep property (CIT) measured using a nanoindenter decreases from the surface of the surface layer toward the lower surface of the substrate in the thickness direction. A creep property CIT(1) in the vicinity of the surface is represented by a creep property when the load is 1 μN, and a creep property CIT(1000) at the deepest part in the thickness direction is represented by a creep property when the load is 1,000 μN. The CIT(1) and CIT(1000) are preferably in the range of from 3.0% to 13.5%, more preferably from 5.0% to 12.0%. Specifically, the creep property CIT(1) in the vicinity of the surface of the surface layer is preferably from 9.5% to 13.5%, more preferably from 9.5% to 12.0%. Further, the creep property CIT(1000) at the deepest part in the thickness direction of the surface layer is preferably from 3.0% to 7.5%, more preferably from 3.0 to 6.5%. Further, the creep property CIT(50) at the intermediate part of the surface layer is preferably from 6.0% to 11.0%, more preferably from 6.0% to 9.5%.

Toner

The toner of the present disclosure has a tensile breaking force F of from 200 to 450 gf (from 1.96 to 4.41 N), measured by a powder layer compression/tensile strength measurement device under a load of 32 kgf (313.81 N).

The powder layer compression/tensile strength measurement device has a container cell that can be vertically divided into two parts. The container cell is filled with toner, and the toner is compressed to form a toner layer. The container cell is then pulled vertically to break the toner layer, and the breaking force at that time is measured as the tensile breaking force F. This device measures the adhesive force between toner particles when the toner layer is compressed.

Generally, the tensile breaking force F of toner is varied, but is about 100 to 200 gf (0.98 to 1.96 N) in many cases. The toner of the present disclosure is characterized by exhibiting a relatively high adhesive force between toner particles when compressed. A part of residual toner particles on the image bearer which have been scraped off by the cleaning blade enters a gap formed between the leading end surface of the cleaning blade and the image bearer at immediately upstream of the contact part. The tensile breaking force F of the toner affects the behavior of the toner in the gap. When the tensile breaking force F of the toner is equal to or more than a certain value, the fluidity of the toner is reduced in the gap, and a toner layer having a width of about several tens micrometers is formed. This toner layer prevents subsequent toner particles from entering the contact part. When the tensile breaking force F of the toner is too high, the toner in the toner layer in the gap stops moving and is exposed to stress due to friction. As a result, the toner adheres to the cleaning blade or enters the contact part and slips therethrough.

In the measurement of the tensile breaking force F of the toner of the present disclosure, the load applied for compressing the toner layer is 32 kgf (313.81 N). As a result of study of the inventors of the present invention, this load condition is found to express most sensitively the difference in performance of toner with respect to the cleaning blade of the present disclosure, with which the adhesive force between toner particles can be properly measured.

It is known that the additive is liberated from the toner dammed by the cleaning blade on the image bearer and supplied to the contact part between the cleaning blade and the image bearer, thus forming an accumulated layer of the additive. The liberated additive entered into the contact part acts as a lubricant between the cleaning blade and the image bearer, and at the same time, is pressed against the image bearer by the contact pressure to cause filming. As the tensile breaking force F of the toner becomes higher, the amount of the additive which enters the contact part becomes smaller, and as a result, the additive is prevented from filming. Although the reason for this is not clear, it is assumed that, when the tensile breaking force F of the toner is high, the additive is less likely to be liberated from the toner, or the liberated additive is recollected by the toner layer.

Therefore, there exists a suitable numerical range for the tensile breaking force F of the toner in view of cleaning performance. The suitable numerical range varies depending on the form of the cleaning blade. For the cleaning blade of the present disclosure, when the tensile breaking force F of the toner is from 200 to 450 gf(1.96 to 4.41 N), improvement in cleaning performance has been confirmed. A more preferred range is from 200 to 350 gf (1.96 to 3.43 N), and a particularly preferred range is from 250 to 300 gf (2.45 to 2.94 N). When the tensile breaking force F is lower than 200 gf (1.96 N), the cleaning performance is deteriorated, or filming of the additive is likely to occur. When the tensile breaking force F is higher than 450 gf (4.41 N), the toner adheres to the cleaning blade, or the cleaning performance is deteriorated.

The tensile breaking force F of the toner measured using a powder layer compression/tensile strength measurement device under a load of 32 kgf (313.81 N) is specifically measured using a compression breaking strength/tensile breaking strength measurement device AGGROBOT AGR-2 (manufactured by Hosokawa Micron Corporation).

Figure 8:
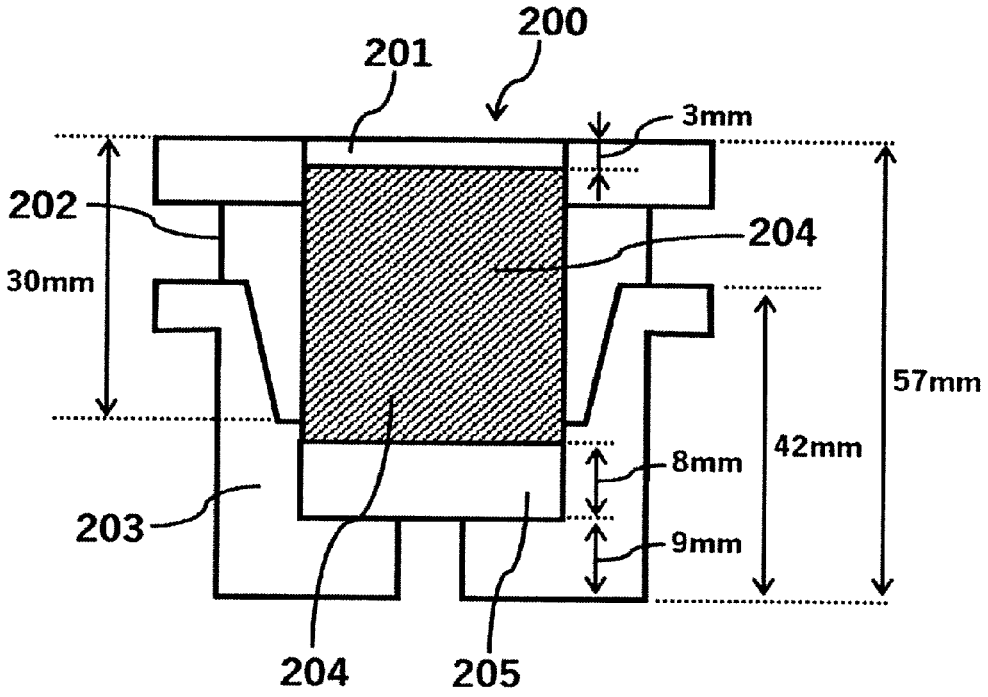
FIG. 8 is a diagram illustrating a powder layer compression/tensile strength measurement device for toner.

FIG. 8 is a diagram illustrating a cell 200 used in the compression breaking strength/tensile breaking strength measurement device AGGROBOT AGR-2 (manufactured by Hosokawa Micron Corporation). The cell 200 includes an upper lid 201, a lower lid 205, an upper cell 202, and a lower cell 203. The inside of the cell is cylindrical. The cell 200 can be heated on the main body stage. The inner diameter of the cell is 25 mm, and the wire diameter of the spring is 1.0 mm. First, the cell 200 is warmed at a set temperature of 32 degrees C. Next, as illustrated in FIG. 8, the cell gets filled with a toner sample 204 in an amount of 5 g. In filling the cell with the toner sample 204, about half of the toner sample is put in the cell and lightly tapped 10 times, and the remaining half is thereafter put therein and lightly tapped 10 times. After that, the upper lid 201 is set on the cell 200, and this state is maintained for about one hour. The maximum compression force is set to 32 kgf (313.81 N), and the toner sample is compressed at a compression rate of 0.1 mm/sec and a compression force of 32 kgf (313.81 N) and held for one minute. After that, the upper cell 202 is pulled up by a tension hook of the main body at a pulling rate of 0.6 mm/sec to pull the toner layer, and the tensile breaking force F when the toner layer is broken is measured. The temperature and humidity in the measurement environment are 23 degrees C. and 60% RH, respectively, and the wire diameter of the spring of the tension hook is 1.0 mm.

In the present disclosure, the method for controlling the tensile breaking force F of the toner is not particularly limited and can be suitably selected to suit to a particular application. Examples thereof include, but are not lot limited to, a method of using a resin having a highly cohesive functional group (e.g., urethane group, urea group) or a thermoplastic elastomer resin (e.g., natural rubber, synthetic rubber) as a binder resin; a method of adjusting the glass transition temperature or molecular weight of the binder resin; a method of adding a plasticizer or the like to the binder resin to lower the melt viscosity; a method of adjusting the melting point of a release agent (e.g., carnauba wax, paraffin wax) or a fixing auxiliary agent (e.g., crystalline polyester resin); a method of adjusting the amount of the release agent or the fixing auxiliary agent exposed at the surface of the toner; a method of adjusting the amount of a fluidizing agent (e.g., silica particles, titanium oxide particles) added to cover the surface of the toner; and a method of using the fluidizing agent that has been treated with a component having high cohesiveness such as silicone oil.

The toner of the present disclosure is not particularly limited in manufacturing method and material and any known method and material can be used as long as the above-described conditions are satisfied. Examples of the manufacturing method include, but are not limited to, kneading-pulverizing methods and chemical methods that granulate toner particles in an aqueous medium.

Specific examples of the chemical methods that granulate toner particles in an aqueous medium include, but are not limited to: suspension polymerization methods, emulsion polymerization methods, seed polymerization methods, and dispersion polymerization methods, each of which uses a monomer as a starting material; dissolution suspension methods in which a resin or resin precursor is dissolved in an organic solvent and then dispersed or emulsified in an aqueous medium; phase-inversion emulsification methods in which a solution comprising a resin or resin precursor and an appropriate emulsifier is phase-inverted by addition of water; and aggregation methods in which resin particles obtained by the above methods are dispersed and aggregated in the aqueous medium and granulated into particles having a desired size by heat melting or the like.

In the present disclosure, for achieving high image quality, the chemical methods are preferred that can provide a toner having a small particle size, a sharp particle size distribution, and a high circularity. Further, for controlling the tensile breaking force of the toner, the above-described dissolution suspension method is preferred that is easy to form a high-molecular-weight material having urethane group and urea group as a binder resin in the toner.

The weight average particle diameter (Dv) of the toner is not particularly limited and can be suitably selected to suit to a particular application. To obtain a high-quality image having excellent granularity, sharpness, and thin-line reproducibility, the weight average particle diameter is preferably from 3 to 10 μm, more preferably from 4 to 7 μm. When the weight average particle diameter is less than 3 μm, sharpness and thin-line reproducibility of the image are excellent, but fluidity and transferability of the toner may be poor. The ratio (Dv/Dn) of the weight average particle diameter (Dv) to the number average particle diameter (Dn) indicates a particle size distribution of toner. The closer the ratio to 1, the sharper the particle size distribution. Preferably, Dv/Dn is 1.20 or less, more preferably 1.15 or less, for sharpness and thin-line reproducibility.

In the present disclosure, the weight average particle diameter (Dv) and the number average particle diameter (Dn) of toner can be measured using an instrument COULTER MULTISIZER III (with an aperture diameter of 100 μm, manufactured by Beckman Coulter, Inc.) and an analysis software program BECKMAN COULTER MULTISIZER 3 (version 3.51) (manufactured by Beckman Coulter, Inc.). Specifically, first, 10 mg of a measurement sample is added to 5 mL of a 10% by mass surfactant (alkylbenzene sulfonate, NEOGEN SC-A, manufactured by DKS Co., Ltd.) and dispersed using an ultrasonic disperser for 1 minute. After that, 25 mL of an electrolytic solution ISOTON III (manufactured by Beckman Coulter, Inc.) was added and dispersed using the ultrasonic disperser for 1 minute to prepare a sample dispersion liquid. Next, 100 mL of the electrolytic solution and an appropriate amount of the sample dispersion liquid are put in a beaker to adjust the particle concentration such that 30,000 particles can be subjected to a measurement in 20 seconds. A particle size distribution of 30,000 particles is then measured to determine the weight average particle diameter (Dv) and the number average particle diameter (Dn).

Preferably, the toner of the present disclosure has an average circularity of from 0.940 to 0.990. More preferably, the toner has an average circularity of from 0.960 to 0.985 and the proportion of particles having a circularity of less than 0.94 in the toner is 15% or less. A substantially spherical toner having the average circularity within the above-described range has an excellent transfer efficiency and is effective for forming a high-definition image having an appropriate density and reproducibility. Further, a thin-line image with few transfer voids can be obtained. This is presumably because the toner surface is sufficiently smooth, so that the number of contact points with the image bearer is reduced and defective transfer of the toner onto the transfer material that causes voids is reduced. In the case of an irregularly-shaped toner too far from a spherical shape having an average circularity below the above-described range, transferability tends to be poor. Conversely, in the case of a toner close to the sphere having an average circularity above the above-described range, transferability is excellent. However, in a system employing blade cleaning, defective cleaning of toner may occur on a photoconductor or transfer belt, causing fouling in the resulting image. For example, in development or transfer of an image having a low image area rate, the amount of residual untransferred toner particles is small, and defective cleaning does not become a particular problem. By contrast, in the case of an image having a high image area rate, such as a colored photographic image, toner particles having been formed into an image may remain on the photoconductor without being transferred due to defective sheet feeding or the like. As such toner particles accumulate, background fouling may appear in the resulting image. In addition, there arises another problem that a charging roller for contact-charging the photoconductor is also contaminated and prevented from exerting the original charging ability.

The average circularity can be measured using a flow particle image analyzer FPIA-3000 (manufactured by SYSMEX CORPORATION). In the measurement, first, a 1% aqueous solution of NaCl is prepared with the first grade sodium chloride and filtered with a 0.45 μm-filter. To 50 to 100 ml of the filtered solution, 0.1 to 5 ml of a surfactant, preferably an alkylbenzene sulfonate, as a dispersant is added, and 1 to 10 mg of a sample is further added. The resultant is subjected to a dispersion treatment using an ultrasonic disperser for 1 minute, and the resultant dispersion liquid having a particle concentration of 5,000 to 15,000 particles/μl is subjected to the measurement. A two-dimensional image of each particle is photographed with a CCD (charge-coupled device) camera, and the diameter of the circle having the same area as the photographed image is calculated as the equivalent circle diameter. The equivalent circle diameter of 0.6 μm or more is considered effective from the accuracy of the pixels of the CCD and used for calculating the average circularity. The average circularity is obtained by calculating the circularity of each particle, adding up the circularity of each particle, and dividing the sum by the total number of particles. The circularity of each particle is calculated by dividing the peripheral length of a circle having the same area as a projected image of the particle by the peripheral length of the projected image of the particle.

The toner of the present disclosure may contain any material as long as the above-described conditions are satisfied. The toner may contain a binder resin, a crystalline resin as a fixing auxiliary agent, a colorant, a release agent, a charge controlling agent, an external additive, a fluidity improving agent, a cleanability improving agent, and/or a magnetic material, as necessary.

The binder resin is not particularly limited and can be suitably selected from known resins to suit to a particular application. Examples thereof include, but are not limited to, homopolymers of styrene or substitutions thereof, such as polystyrene, poly p-styrene, and polyvinyl toluene; styrene-based copolymers such as styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isopropyl copolymer, and styrene-maleate copolymer; and polymethyl methacrylate resin, polybutyl methacrylate resin, polyvinyl chloride resin, polyvinyl acetate resin, polyethylene resin, polyester resin, polyurethane resin, epoxy resin, polyvinyl butyral resin, polyacrylic acid resin, rosin resin, modified rosin resin, terpene resin, phenol resin, aliphatic or aromatic hydrocarbon resin, aromatic petroleum resin, and these resins modified to have a functional group reactive with an active hydrogen group. Each of these materials can be used alone or in combination with others.

Among these, polyester resin is preferred for low-temperature fixability of the toner. Further, for low-temperature fixability and hot offset resistance, polyester resin is preferably used in combination with another polyester resin modified to have a functional group reactive with an active hydrogen group is preferred.

Examples of the active hydrogen group include, but are not limited to, hydroxyl groups (e.g., alcoholic hydroxyl group, phenolic hydroxyl group), amino group, carboxyl group, and mercapto group. Each of these can be used alone or in combination with others.

Examples of the functional group reactive with an active hydrogen group include, but are not limited to, isocyanate group, epoxy group, carboxylic acid group, and acid chloride group. Among these, isocyanate group is preferred because it makes it possible to introduce urethane bond or urea bond that has a high cohesive force for controlling the tensile breaking force.

The polyester resin is obtained from a polyol and a polycarboxylic acid or derivative thereof, such as a polycarboxylic acid anhydride and a polycarboxylic acid ester.

Examples of the polyol include, but are not limited to: alkylene (C2-C3) oxide adduct (with an average addition molar number of 1-10) of bisphenol A such as polyoxypropylene (2.2)-2,2-bis(4-hydroxyphenyl)propane and polyoxyethylene (2.2)-2,2-bis(4-hydroxyphenyl)propane; hydrogenated bisphenol A and alkylene (C2-C3) oxide adduct (with an average addition molar number of 1-10) of hydrogenated bisphenol A; aliphatic diols such as ethylene glycol, 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol; diols having an oxyalkylene group, such as diethylene glycol, triethylene glycol, dipropylene glycol, polyethylene glycol, polypropylene glycol, and polytetramethylene glycol; alicyclic diols such as 1,4-cyclohexanedimethanol and hydrogenated bisphenol A; and trivalent or higher alcohols such as glycerin, pentaerythritol, and trimethylolpropane. Each of these can be used alone or in combination with others.

Examples of the polycarboxylic acid include, but are not limited to: adipic acid, phthalic acid, isophthalic acid, terephthalic acid, fumaric acid, and maleic acid; dicarboxylic acids such as succinic acid substituted with an alkyl group having 1 to 20 carbon atoms or an alkenyl group having 2 to 20 carbon atoms, such as dodecenyl succinic acid and octyl succinic acid; and trivalent or higher carboxylic acids such as trimellitic acid, pyromellitic acid, and acid anhydrides thereof. Each of these can be used alone or in combination with others.

Preferred examples of the crystalline resin include those meltable at around the fixing temperature. When the toner contains such a crystalline resin, the crystalline resin melts and becomes compatible with the binder resin at the fixing temperature, thus improving sharply-melting property of the toner and exerting excellent low-temperature fixability.

The crystalline resin is not particularly limited and can be suitably selected to suit to a particular application as long as it has crystallinity. Examples thereof include, but are not limited to, polyester resin, polyurethane resin, polyurea resin, polyamide resin, polyether resin, vinyl resin, and modified crystalline resin. Each of these can be used alone or in combination with others. Among these, polyester resin is preferred.

The melting point of the crystalline resin is not particularly limited, but is preferably from 60 to 100 degrees C. When the melting point is lower than 60 degrees C., the crystalline resin is likely to start melting at low temperatures, and heat-resistant storage stability of the toner may deteriorate. When the melting point is higher than 100 degrees C., the crystalline resin is not very effective for improving low-temperature fixability.

Since the amount of the crystalline resin present at the surface of the toner affects the tensile breaking force of the toner, it can also be used as means for controlling the tensile breaking force F. The proportion of the crystalline resin present at the surface of the toner can be measured by an ATR (Attenuated Total Reflection) method using a Fourier transform infrared spectrometer (FT-IR), and is preferably from 15% to 60% by mass, more preferably from 20% to 40% by mass.

According to the measurement principle of the ATR (Attenuated Total Reflection) method using a Fourier transform infrared spectrometer (FT-IR), the analysis depth is about 0.3 μm. Thus, a relative weight ratio (% by mass) of the crystalline resin in a region extending from the surface of a toner particle to a depth of 0.3 μm can be measured.

The Fourier transform infrared spectrometer is not particularly limited. Specific examples thereof include a Fourier transform infrared spectrometer Nicolet™ iS™ 10 (available from Thermo Fisher Scientific K.K.).

In a specific measurement procedure, first, 3 g of the toner is compressed with a load of 6 t for 1 minute using an automatic pelletizer (Type M No. 50 BRP-E available from Maekawa Testing Machine Mfg. Co., LTD.) and formed into a toner pellet having a diameter of 40 mm and a thickness of about 2 mm. Next, the toner pellet is set in a germanium (Ge) crystal measurement window of the measuring instrument, and an IR spectrum is measured at a resolution of 4 $cm^{-1}$ 20 times in total. From the resultant IR spectrum, a peak intensity (Pc) derived from the crystalline resin and a peak intensity (Pr) derived from the binder resin are selected, and the intensity ratio (Pc/Pr) is calculated. At this time, it is desirable that the peak intensity (Pc) derived from the crystalline resin and the peak intensity (Pr) derived from the binder resin be selected from those not overlapped with peaks derived from other materials as much as possible. On the other hand, a calibration curve for the amount of the crystalline resin is prepared in advance by varying the mixing ratio of the crystalline resin and the binder resin. The relative weight ratio of the crystalline resin at the surface of the toner is determined from the intensity ratio (Pc/Pr), and the amount of the crystalline resin is determined from the calibration curve. The measurement is performed at 4 different positions, and the average value is employed.

The colorant is not particularly limited and can be suitably selected from known dyes and pigments to suit to a particular application. Examples thereof include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Each of these can be used alone or in combination with others.

The proportion of the colorant in the toner is not particularly limited, but is preferably from 1% to 15% by mass, more preferably from 3% to 10% by mass. When the proportion is less than 1% by mass, the coloring power of the toner may decrease. When the proportion exceeds 15% by mass, the colorant may be poorly dispersed in the toner, causing deterioration of the coloring power and electric properties of the toner.

The colorant may be combined with a resin to be used as a master batch. The resin is not particularly limited and suitably selected from known ones to suit to a particular application. Examples thereof include, but are not limited to, polymers of styrene or substitutions thereof, styrene-based copolymers, polymethyl methacrylate resin, polybutyl methacrylate resin, polyvinyl chloride resin, polyvinyl acetate resin, polyethylene resin, polypropylene resin, polyester resin, epoxy resin, epoxy polyol resin, polyurethane resin, polyamide resin, polyvinyl butyral resin, polyacrylic acid resin, rosin, modified rosin, terpene resin, aliphatic hydrocarbon resin, alicyclic hydrocarbon resin, aromatic petroleum resin, chlorinated paraffin, and paraffin. Each of these can be used alone or in combination with others.

The release agent is not particularly limited and suitably selected from known ones to suit to a particular application. Examples thereof include, but are not limited to, waxes such as carbonyl-group-containing waxes, polyolefin waxes, and long-chain hydrocarbon waxes. Each of these can be used alone or in combination with others. Among these, carbonyl-group-containing waxes are preferred.

Examples of the carbonyl-group-containing waxes include, but are not limited to: polyalkanoic acid esters such as carnauba wax, montan wax, trimethylolpropane tribehenate, pentaerythritol tetrabehenate, pentaerythritol diacetate dibehenate, glycerin tribehenate, and 1,18-octadecanediol distearate; polyalkanol esters such as tristearyl trimellitate and distearyl maleate; polyalkanoic acid amides such as dibehenylamide; polyalkyl amides such as trimellitic acid tristearylamide; and dialkyl ketones such as distearyl ketone.

Examples of the polyolefin waxes include, but are not limited to, polyethylene wax and propylene wax.

Examples of the long-chain hydrocarbon waxes include, but are not limited to, paraffin wax and SASOL wax.

The melting point of the release agent is not particularly limited and can be suitably selected to suit to a particular application, but is preferably from 40 to 160 degrees C., more preferably from 50 to 120 degrees C., and most preferably from 60 to 90 degrees C. When the melting point is 40 degrees C. or higher, heat-resistant storage stability is good. When the melting point is 160 degrees C. or lower, cold offset is less likely to occur when the toner is fixed at a low temperature.

The proportion of the release agent in the toner is not particularly limited, but is preferably from 1% to 20% by mass, more preferably from 3% to 15% by mass, and most preferably from 3% to 7% by mass. When the proportion is 20% by mass or less, fluidity of the toner is improved.

The charge controlling agent is not particularly limited and can be suitably selected to suit to a particular application. Examples thereof include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphorous and phosphorous-containing compounds, tungsten and tungsten-containing compounds, fluorine activators, metal salts of salicylic acid, and metal salts of salicylic acid derivatives.

Specific examples thereof include, but are not limited to: BONTRON 03 (nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), available from Orient Chemical Industries Co., Ltd.; TP-302 and TP-415 (molybdenum complexes of quaternary ammonium salts), available from Hodogaya Chemical Co., Ltd.; LRA-901, and LR-147 (boron complex), available from Japan Carlit Co., Ltd.; and cooper phthalocyanine, perylene, quinacridone, azo pigments, and polymeric compounds having a functional group such as a sulfonate group, a carboxyl group, and a quaternary ammonium group.

The content of the charge controlling agent is not particularly limited. Preferably, the content of the charge controlling agent in 100 parts by mass of the toner is from 0.1 to 10 parts by mass, more preferably from 0.2 to 5 parts by mass.

When the content is 10 parts by mass or less, chargeability of the toner becomes appropriate, and a decrease in the fluidity of the developer and a decrease in the image density hardly occur. The charge controlling agent may be dispersed in the toner or fixed to the surface of the toner by physical adsorption or chemical adsorption.

The external additive is not particularly limited and can be suitably selected from known materials to suit to a particular application. Examples thereof include, but are not limited to, silica particles, hydrophobized silica particles, metal salts of fatty acids (e.g., zinc stearate, aluminum stearate), metal oxides (e.g., titanium oxide, alumina, tin oxide, antimony oxide), hydrophobized metal oxide particles, and fluoropolymers. Among these, hydrophobized silica particles, hydrophobized titanium oxide particles, and hydrophobized alumina particles are preferred.

Specific examples of the silica particles include, but are not limited to: HDK H 2000, HDK H 2000/4, HDK H 2050EP, HVK 21, and HDK H 1303 (available from Hoechst AG); and R972, R974, RX200, RY200, R202, R805, and R812 (available from Nippon Aerosil Co., Ltd.).

Specific examples of the titanium oxide particles include, but are not limited to: P-25 (available from Nippon Aerosil Co., Ltd.); STT-30 and STT-65C-S(available from Titan Kogyo, Ltd.); TAF-140 (available from Fuji Titanium Industry Co., Ltd.); MT-150W, MT-500B, MT-600B, and MT-150A (available from TAYCA Corporation); T-805 (available from Nippon Aerosil Co., Ltd.); STT-30A and STT-65S-S(available from Titan Kogyo, Ltd.); TAF-500T and TAF-1500T (available from Fuji Titanium Industry Co., Ltd.); MT-100S and MT-100T (available from TAYCA Corporation); and IT-S(available from Ishihara Sangyo Kaisha, Ltd.).

The hydrophobized silica particles, the hydrophobized titanium oxide particles, and the hydrophobized alumina particles can be obtained by treating silica particles, titanium oxide particles, and alumina particles, respectively, which are hydrophilic, with a silane coupling agent such as methyltrimethoxysilane, methyltriethoxysilane, and octyltrimethoxysilane.

In addition, silicone-oil-treated inorganic particles treated with a silicone oil, optionally with application of heat, are also suitable as the external additive.

The proportion of the external additive in the toner is preferably from 0.1% to 5% by mass, more preferably from 0.3% to 3% by mass.

Examples of the external additive further include resin particles. Specific examples of the resin particles include, but are not limited to, polystyrene particles obtained by soap-free emulsion polymerization, suspension polymerization, or dispersion polymerization; particles of copolymer of methacrylates and/or acrylates; particles of polycondensation polymer such as silicone, benzoguanamine, and nylon; and thermosetting resin particles. By using such resin particles in combination, chargeability of the toner is enhanced, the amount of reversely-charged toner particles is reduced, and the degree of background fog is reduced. The proportion of the resin particles in the toner is preferably from 0.01% to 5% by mass, more preferably from 0.1% to 2% by mass.

The fluidity improving agent refers to a toner surface treatment agent that improves hydrophobicity of the toner to prevent deterioration of fluidity and chargeability of the toner even under high-humidity environments. Specific examples of the fluidity improving agent include, but are not limited to, silane coupling agents, silylation agents, silane coupling agents having a fluorinated alkyl group, organic titanate coupling agents, aluminum coupling agents, silicone oils, and modified silicone oils.

The cleanability improving agent is an additive that facilitates removal of the toner remaining on an electrostatic latent image bearer or intermediate transferor after image transfer. Examples thereof include, but are not limited to, metal salts of fatty acids (e.g., zinc stearate, calcium stearate) and polymer particles prepared by soap-free emulsion polymerization (e.g., polymethyl methacrylate particles, polystyrene particles). Preferably, the particle size distribution of the polymer particles is as narrow as possible. More preferably, the weight average particle diameter thereof is in the range of from 0.01 to 1 μm.

The magnetic material is not particularly limited and can be suitably selected from known ones to suit to a particular application. Examples thereof include, but are not limited to, iron powder, magnetite, and ferrite. In particular, those having white color tone are preferred.

Developer

A developer of the present disclosure contains the above-described toner and other components suitably selected in accordance with a need, such as a carrier.

The developer may be either a one-component developer or a two-component developer. To be used for high-speed printers corresponding to recent improvement in information processing speed, two-component developer is preferred for an extended lifespan.

In the case of a one-component developer, even when toner supply to the developer and toner consumption for developing image are repeatedly performed, the particle diameter of the toner fluctuates very little. In addition, neither toner filming on a developing roller nor toner fusing to a layer thickness regulating member (e.g., a blade for forming a thin layer of toner) occurs. Thus, even when the developer is used (stirred) in a developing device for a long period of time, developability and image quality remain good and stable.

In the case of a two-component developer, even when toner supply and toner consumption are repeatedly performed for a long period of time, the particle diameter of the toner fluctuates very little. Thus, even when the developer is stirred in a developing device for a long period of time, developability and image quality remain good and stable.

The carrier is not particularly limited and can be suitably selected to suit to a particular application. Preferably, the carrier comprises a core material and a resin layer coating the core material.

The core material is not particularly limited and can be suitably selected from known ones. Examples thereof include, but are not limited to, manganese-strontium (Mn—Sr) materials and manganese-magnesium (Mn—Mg) materials having a magnetization of from 50 to 90 emu/g. For securing image density, high magnetization materials such as iron powders having a magnetization of 100 emu/g or more and magnetites having a magnetization of from 75 to 120 emu/g are preferred. Additionally, low magnetization materials such as copper-zinc (Cu—Zn) materials having a magnetization of from 30 to 80 emu/g are preferred for improving image quality, because such materials are capable of reducing the impact of the magnetic brush to an electrostatic latent image bearer. Each of these can be used alone or in combination with others.

The core material preferably has a weight average particle diameter (D50) of from 10 to 200 μm, more preferably from 40 to 100 μm. When the weight average particle diameter (D50) is 10 μm or more, the number of ultrafine particles is reduced in the particle size distribution of the carrier particles, the magnetization per particle is increased, and carrier scattering is prevented. When the weight average particle diameter (D50) is 200 μm or less, the specific surface area is increased, toner scattering is prevented, and reproducibility of solid portions is increased in full-color images that have many solid portions.

The material of the resin layer is not particularly limited and can be suitably selected from known resins to suit to a particular application. Examples thereof include, but are not limited to, amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymer of vinylidene fluoride with an acrylic monomer, copolymer of vinylidene fluoride with vinyl fluoride, fluoroterpolymer (e.g., terpolymer of tetrafluoroethylene, vinylidene fluoride, and non-fluoride monomer), and silicone resin. Each of these can be used alone or in combination with others. Among these, silicone resin is particularly preferred.

The silicone resin is not particularly limited and can be suitably selected from generally known silicone resins to suit to a particular application. Examples thereof include, but are not limited to, a straight silicone resin consisting of organosiloxane bonds only, and a modified silicone resin modified with alkyd resin, polyester resin, epoxy resin, acrylic resin, or urethane resin.

Commercially available products of the silicone resin can be used. Specific examples of the straight silicone resin include, but are not limited to: KR271, KR255, and KR152 (available from Shin-Etsu Chemical Co., Ltd.); and SR2400, SR2406, and SR2410 (available from Dow Corning Toray Co., Ltd.).

Commercially available products of the modified silicone resin can be used. Specific examples of the modified silicone resins include, but are not limited to, KR206 (alkyd-modified), KR5208 (acrylic-modified), ES1001N (epoxy-modified), and KR305 (urethane-modified), available from Shin-Etsu Chemical Co., Ltd.; and SR2115 (epoxy-modified) and SR2110 (alkyd-modified), available from Dow Corning Toray Co., Ltd.

The silicone resin may be used alone or in combination with a cross-linkable component and/or a charge amount controlling agent.

The resin layer may further contain a conductive powder, as necessary. Examples thereof include, but are not limited to, metal powder, carbon black, titanium oxide, tin oxide, and zinc oxide. Preferably, the conductive powder has an average particle diameter of 1 μm or less. When the average particle diameter is 1 μm or less, it is easy to control electrical resistance.

The resin layer can be formed by, for example, dissolving the silicone resin, etc., in a solvent to prepare a coating liquid and uniformly coating the surface of the core material with the coating liquid by a known coating method, followed by drying and baking. Examples of the coating method include, but are not limited to, a dipping method, a spraying method, and a brush coating method.

The solvent is not particularly limited and can be suitably selected to suit to a particular application. Examples thereof include, but are not limited to, toluene, xylene, methyl ethyl ketone, methyl isobutyl ketone, cellosolve, and butyl acetate.

The baking method is not particularly limited and may be either an external heating method or an internal heating method. Examples thereof include a method using a stationary electric furnace, a fluid electric furnace, a rotary electric furnace, or a burner furnace, and a method using microwave.

Preferably, the proportion of the resin layer in the carrier is from 0.01% to 5.0% by mass. When the proportion is 0.01% by mass or more, the resin layer is uniformly formed on the surface of the core material. When the proportion is 5.0% by mass or less, the thickness of the resin layer becomes appropriate, and carrier particles are uniformly granulated without coalescence.

In the case of a two-component developer, the proportion of the carrier in the two-component developer is not particularly limited and can be suitably selected to suit to a particular application, but is preferably from 90% to 98% by mass, more preferably from 93% to 97% by mass.

In the two-component developer, preferably, 1 to 10.0 parts by mass of the toner is mixed with 100 parts by mass of the carrier.

Image Forming Apparatus

An image forming apparatus according to an embodiment of the present invention includes: an image bearer; an electrostatic latent image forming device configured to form an electrostatic latent image on the image bearer; a visible image forming device containing a toner, configured to develop the electrostatic latent image with the toner to form a visible image; and a cleaning blade configured to remove toner particles remaining on the image bearer. An image forming apparatus according to a preferred embodiment of the present invention includes: an image bearer; a charger configured to charge a surface of the image bearer; an irradiator configured to irradiate the charged surface of the image bearer to form an electrostatic latent image; a developing device containing a toner, configured to develop the electrostatic latent image with the toner to form a visible image; a transfer device configured to transfer the visible image onto a recording medium; a fixing device configured to fix the transferred visible image on the recording medium; and a cleaner configured to remove toner particles remaining on the image bearer. Here, the cleaner is the cleaning blade according to an embodiment of the present invention, and the toner is the toner according to an embodiment of the present invention. The image bearer may be provided with a mechanism for applying a lubricant as a cleaning assisting device.

Image Forming Method

An image forming method according to an embodiment of the present invention includes the steps of: forming an electrostatic latent image on an image bearer; developing the electrostatic latent image with a toner to form a visible image; and removing toner particles remaining on the image bearer with a cleaning blade. An image forming method according to a preferred embodiment of the present invention includes the steps of: charging a surface of the image bearer; irradiating the charged surface of the image bearer to form an electrostatic latent image; developing the electrostatic latent image with a toner to form a visible image; transferring the visible image onto a recording medium; fixing the transferred visible image on the recording medium; and removing toner particles remaining on the image bearer. Here, the cleaning blade according to an embodiment of the present invention is used in the step of removing, and the toner according to an embodiment of the present invention is used.

Process Cartridge

A process cartridge according to an embodiment of the present invention comprises the image forming apparatus according to an embodiment of the present invention.

As an example of the image forming apparatus according to an embodiment of the present invention, an electrophotographic printer 500 is described in detail below. First, the basic configuration of the printer 500 is described.

Figure 9:
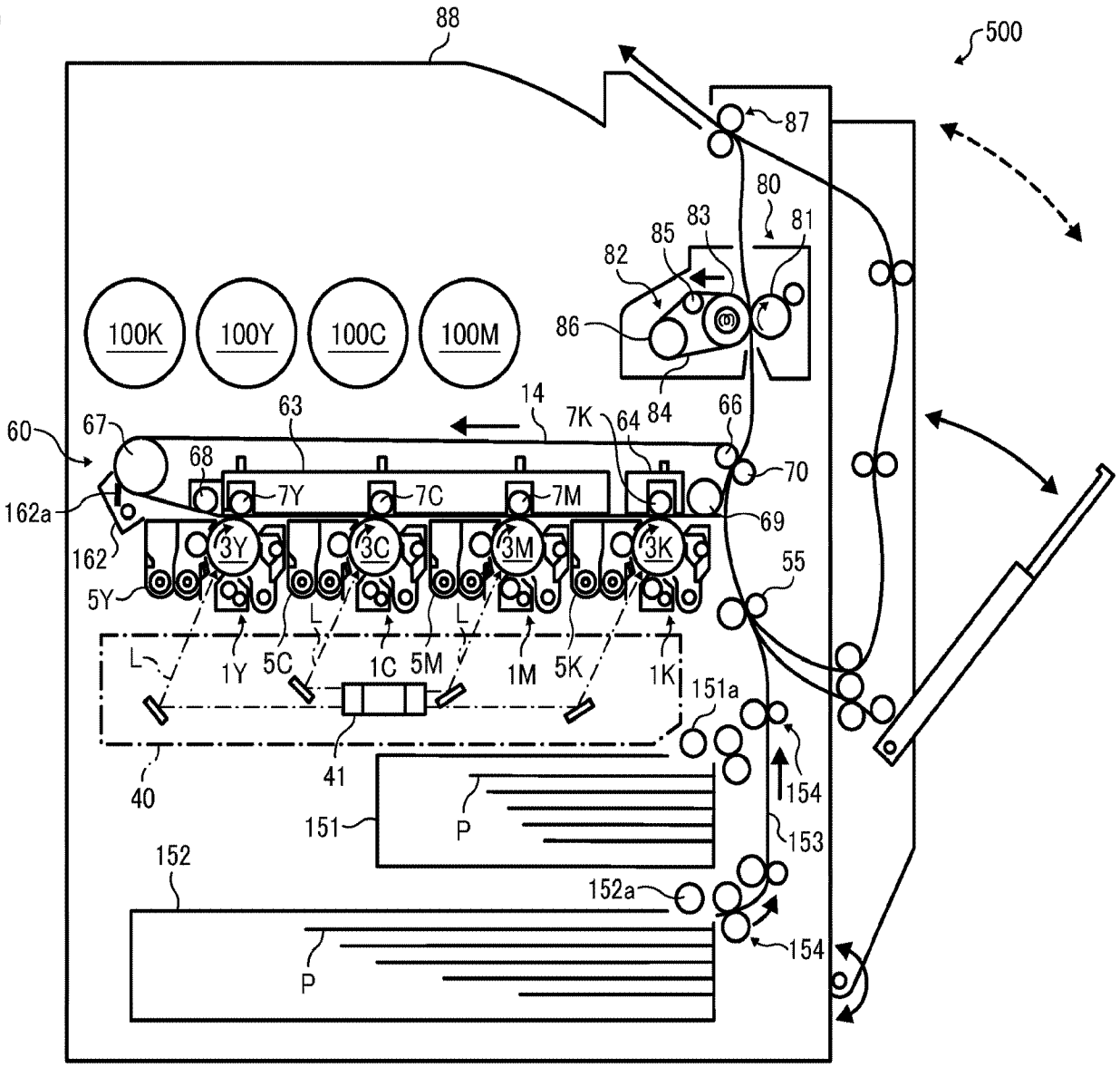
FIG. 9 is a schematic diagram illustrating an image forming apparatus according to an embodiment of the present invention.

FIG. 9 is a schematic diagram illustrating the printer 500. The printer 500 includes four image forming units 1Y, 1C, 1M, and 1K for forming yellow, cyan, magenta, and black images, respectively. The image forming units 1Y, 1C, 1M, and 1K have the same configuration except for storing different color toners, i.e., yellow, cyan, magenta, and black toners, respectively, as image forming materials.

Above the four image forming units 1Y, 1C, 1M, and 1K (hereinafter collectively "image forming units 1"), a transfer unit 60 is disposed. The transfer unit 60 includes an intermediate transfer belt 14 as an intermediate transferor. The image forming units 1Y, 1C, 1M, and 1K include respective photoconductors 3Y, 3C, 3M, and 3K on which toner images with respective colors are to be formed. The toner images are superimposed on one another on a surface of the intermediate transfer belt 14.

Below the four image forming units 1, an optical writing unit 40 is disposed. The optical writing unit 40, serving as a latent image forming device, emits laser light L based on image information to the photoconductors 3Y, 3C, 3M, and 3K in the respective image forming units 1Y, 1C, 1M, and 1K. Thus, electrostatic latent images for yellow, cyan, magenta, and black images are formed on the respective photoconductors 3Y, 3C, 3M, and 3K. In the optical writing unit 40, the laser light L is emitted from a light source, deflected by a polygon mirror 41 that is rotary-driven by a motor, and directed to the photoconductors 3Y, 3C, 3M, and 3K through multiple optical lenses and mirrors. Alternatively, the optical writing unit 40 can be replaced with another unit in which an LED (light emitting diode) array performs optical scanning.

Below the optical writing unit 40, a first sheet feeding cassette 151 and a second sheet feeding cassette 152 are disposed so as to overlap in the vertical direction. In each sheet feeding cassette, multiple transfer sheets P, serving as recording media, are stacked on top of another. The top transfer sheet P in each sheet feeding cassette is in contact with a first sheet feeding roller 151*a* or a second sheet feeding roller 152*a*. As the first sheet feeding roller 151*a* is rotary-driven counterclockwise in FIG. 9 by a driver, the top transfer sheet P in the first sheet feeding cassette 151 is fed to a sheet feeding path 153 that is vertically extended on a right side of the sheet feeding cassettes in FIG. 9. As the second sheet feeding roller 152*a* is rotary-driven counterclockwise in FIG. 9 by a driver, the top transfer sheet P in the second sheet feeding cassette 152 is fed to the sheet feeding path 153.

On the sheet feeding path 153, multiple conveyance roller pairs 154 are disposed. The transfer sheet P fed to the sheet feeding path 153 is conveyed upward in FIG. 9 while being nipped by the rollers of the conveyance roller pairs 154.

On a downstream end of the sheet feeding path 153 relative to the direction of conveyance of the transfer sheet P, a registration roller pair 55 is disposed. The rollers of the registration roller pair 55 nip the transfer sheet P fed by the conveyance roller pairs 154 and stop rotating immediately thereafter. The registration roller pair 55 then timely feeds the transfer sheet P to a secondary transfer nip to be described later.

Figure 10:
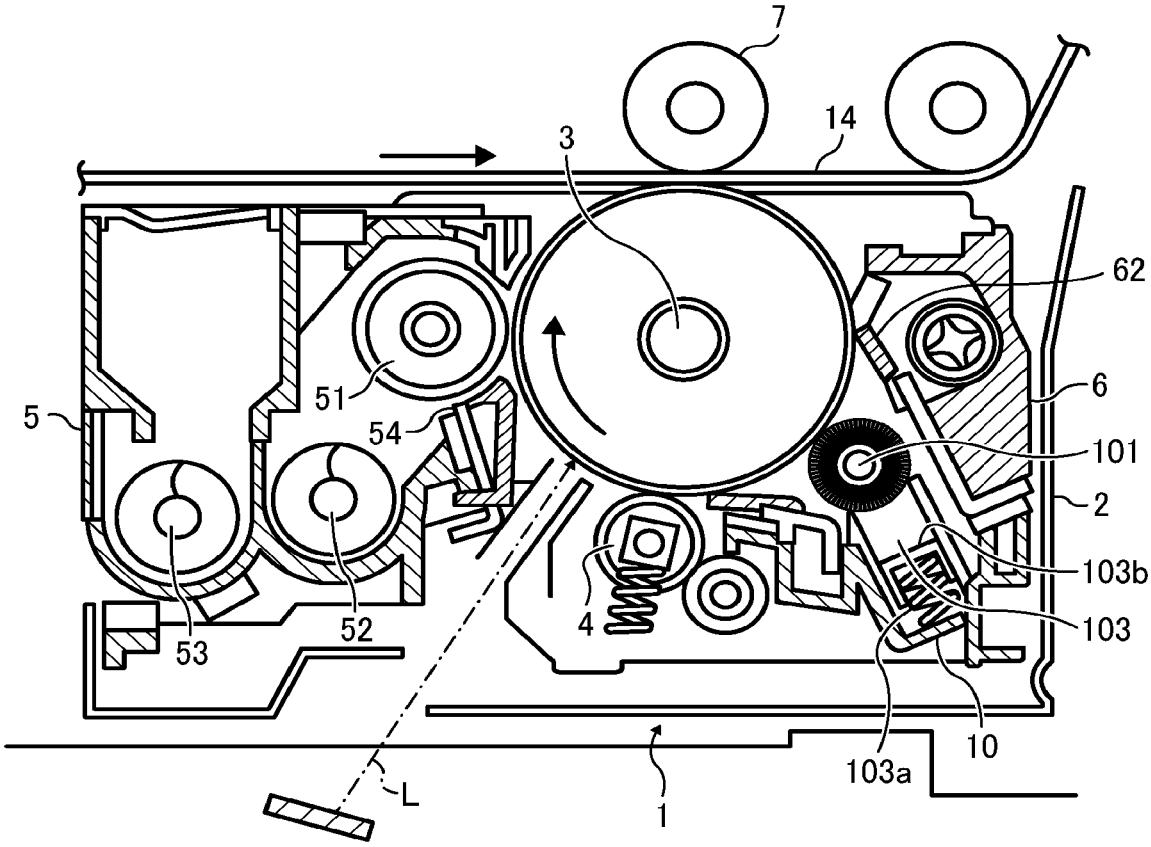
FIG. 10 is a schematic diagram illustrating an image forming unit in the image forming apparatus according to an embodiment of the present invention.

FIG. 10 is a schematic diagram illustrating one of the four image forming units 1.

As illustrated in FIG. 10, the image forming unit 1 includes a drum-like photoconductor 3 serving as an image bearer. The photoconductor 3 is in a drum-like shape but may also be in a sheet-like shape or an endless-belt-like shape.

Around the photoconductor 3, a charging roller 4, a developing device 5, a primary transfer roller 7, a cleaner 6, a lubricant applicator 10, and a neutralization lamp are disposed. The charging roller 4 is a charging member of a charger. The developing device 5 is configured to develop a latent image formed on a surface of the photoconductor 3 into a toner image. The primary transfer roller 7 is a primary transfer member of a primary transfer device, and is configured to transfer the toner image on the surface of the photoconductor 3 onto the intermediate transfer belt 14. The cleaner 6 is configured to remove residual toner particles remaining on the photoconductor 3 after the toner image has been transferred therefrom onto the intermediate transfer belt 14. The lubricant applicator 10 is configured to apply a lubricant to the surface of the photoconductor 3 having been cleaned by the cleaner 6. The neutralization lamp is a neutralizer configured to neutralize the surface potential of the photoconductor 3 having been cleaned.

The charging roller 4 is disposed at a distance from the photoconductor 3 without contacting the photoconductor 3. The charging roller 4 is configured to charge the photoconductor 3 to a predetermined potential with a predetermined polarity. After the charging roller 4 has uniformly charged the surface of the photoconductor 3, the optical writing unit 40 emits the laser light L to the charged surface of the photoconductor 3 based on image information to form an electrostatic latent image.

The developing device 5 includes a developing roller 51 serving as a developer bearer. The developing roller 51 is configured to be applied with a developing bias from a power source. In the casing of the developing device 5, a supply screw 52 and a stirring screw 53 are provided for stirring the developer contained in the casing while conveying the developer in opposite directions. Also, a doctor 54 for regulating the developer carried on the developing roller 51 is disposed within the casing. As the developer is stirred and conveyed by the supply screw 52 and the stirring screw 53, toner particles in the developer are charged to have a predetermined polarity. The developer is then carried on the surface of the developing roller 51 and regulated by the doctor 54. Toner particles in the developer adhere to a latent image formed on the photoconductor 3 at a developing region where the developing roller 51 faces the photoconductor 3.

The cleaner 6 includes a fur brush 101 and the cleaning blade 62. The cleaning blade 62 is in contact with the photoconductor 3 so as to face in the direction of movement of the surface of the photoconductor 3. The cleaning blade 62 is the cleaning blade according to an embodiment of the present invention. The lubricant applicator 10 includes a solid lubricant 103 and a lubricant pressing spring 103*a*. The fur brush 101 serves as an application brush that applies the solid lubricant 103 to the photoconductor 3. The solid lubricant 103 is held by a bracket 103*b* and pressed toward the fur brush 101 by the lubricant pressing spring 103*a*. As the fur brush 101 rotates so as to trail the rotation of the photoconductor 3, the solid lubricant 103 is scraped by the fur brush 101 and the scraped-off lubricant is applied to the photoconductor 3. By application of the lubricant to the photoconductor 3, it is preferable that the coefficient of friction of the surface of the photoconductor 3 be maintained at 0.2 or less during non-image forming periods.

The charger of the present embodiment employs a non-contact proximity arrangement system in which the charging roller 4 is disposed in proximity to the photoconductor 3 without contacting the photoconductor 3. Alternatively, any known charger such as a corotron, a scorotron, and a solid state charger can also be used as the charger. Among these charging systems, contact charging systems and non-contact proximity arrangement systems are preferred, since they have advantages of high charging efficiency, less generation of ozone, and compact size.

Examples of the light source of the optical writing unit 40 that emits the laser light L and the light source of the neutralization lamp include all luminous matters such as fluorescent lamp, tungsten lamp, halogen lamp, mercury lamp, sodium-vapor lamp, light-emitting diode (LED), laser diode (LD), and electroluminescence (EL). For the purpose of emitting only light having a desired wavelength, any type of filter can be used, such as sharp cut filter, band pass filter, near infrared cut filter, dichroic filter, interference filter, and color-temperature conversion filter. Among these light sources, light-emitting diode and semiconductor laser are preferred since they can emit long-wavelength light (600-800 nm) with high energy.

The transfer unit 60 serving as a transfer device further includes, in addition to the intermediate transfer belt 14, a belt cleaning unit 162, a first bracket 63, and a second bracket 64. The transfer unit 60 further includes four primary transfer rollers 7Y, 7C, 7M, and 7K, a secondary transfer backup roller 66, a driving roller 67, an auxiliary roller 68, and a tension roller 69. The intermediate transfer belt 14 is stretched taut with these eight rollers and is rotary-driven by the driving roller 67 to endlessly move counterclockwise in FIG. 9. The four primary transfer rollers 7Y, 7C, 7M, and 7K and the respective photoconductors 3Y, 3C, 3M, and 3K are sandwiching the intermediate transfer belt 14 that is endlessly moved, forming respective primary transfer nips therebetween. The back surface (i.e., inner circumferential surface of the loop) of the intermediate transfer belt 14 is then applied with a transfer bias having the opposite polarity to the toner (e.g., positive polarity). As the intermediate transfer belt 14 endlessly moves while sequentially passing the primary transfer nips of yellow, cyan, magenta, and black, the toner images of yellow, cyan, magenta, and black formed on the respective photoconductors 3Y, 3C, 3M, and 3K are superimposed on one another on the outer circumferential surface of the intermediate transfer belt 14. Thus, a composite toner image in which four color toner images are superimposed on one another is formed on the intermediate transfer belt 14.

The secondary transfer backup roller 66 and a secondary transfer roller 70, disposed outside the loop of the intermediate transfer belt 14, are sandwiching the intermediate transfer belt 14 to form a secondary transfer nip therebetween. The registration roller pair 55 feeds the transfer sheet P to the secondary transfer nip in synchronization with an entry of the composite toner image on the intermediate transfer belt 14 into the secondary transfer nip. The composite toner image on the intermediate transfer belt 14 is secondarily transferred onto the transfer sheet P in the secondary transfer nip by the actions of a secondary transfer electric field and the nip pressure. The secondary transfer electric field is formed between the secondary transfer roller 70 to which a secondary transfer bias is applied and the secondary transfer backup roller 66. The composite toner image is combined with the white color of the transfer sheet P to become a full-color toner image.

On the intermediate transfer belt 14 having passed through the secondary transfer nip, residual toner particles which have not been transferred onto the transfer sheet P are remaining. These residual toner particles are removed by the belt cleaning unit 162. The belt cleaning unit 162 includes a belt cleaning blade 162*a* in contact with the outer circumferential surface of the intermediate transfer belt 14. The belt cleaning blade 162*a* scrapes off the residual toner particles from the intermediate transfer belt 14.

The first bracket 63 of the transfer unit 60 is swingable about the rotation axis of the auxiliary roller 68 at a predetermined angle in accordance with on/off driving operation of a solenoid. When the printer 500 is to form a black-and-white image, the first bracket 63 is slightly rotated counterclockwise in FIG. 9 by driving the solenoid. This rotation of the first bracket 63 makes the primary transfer rollers 7Y, 7C, and 7M revolve counterclockwise in FIG. 9 about the rotation axis of the auxiliary roller 68 to bring the intermediate transfer belt 14 away from the photoconductors 3Y, 3C, and 3M. Thus, among the four image forming units 1Y, 1C, 1M, and 1K, only the image forming unit 1K for black image is brought into operation to form a black-and-white image. Since unnecessary driving of the image forming units 1Y, 1C, and 1M is avoid during formation of the black-and-white image, undesired deterioration of compositional members of the image forming units 1Y, 1C, and 1M can be prevented.

Above the secondary transfer nip, a fixing unit 80 is disposed. The fixing unit 80 includes a pressure heating roller 81 and a fixing belt unit 82. The pressure heating roller 81 contains a heat source, such as a halogen lamp, inside. The fixing belt unit 82 includes a fixing belt 84, serving as a fixing member, a heating roller 83, a tension roller 85, a driving roller 86, and a temperature sensor. The heating roller 83 contains a heat source, such as a halogen lamp, inside. The fixing belt 84 in an endless-belt-like form is stretched taut with the heating roller 83, the tension roller 85, and the driving roller 86, and is endlessly moved counter-clockwise in FIG. 9. The fixing belt 84 is heated from its back surface side by the heating roller 83 while endlessly moving. At a position where the fixing belt 84 is wound around the heating roller 83, the pressure heating roller 81 is contacting the outer circumferential surface of the fixing belt 84. The pressure heating roller 81 is driven to rotate clockwise in FIG. 9. Thus, the pressure heating roller 81 and the fixing belt 84 form a fixing nip therebetween.

The temperature sensor is disposed outside the loop of the fixing belt 84 facing the outer circumferential surface of the fixing belt 84 forming a predetermined gap therebetween. The temperature sensor detects the surface temperature of the fixing belt 84 immediately before entering into the fixing nip. The detection result is transmitted to a fixing power supply circuit. The fixing power supply circuit on/off controls power supply to the heat sources contained in the heating roller 83 and the pressure heating roller 81 based on the detection result.

The transfer sheet P having passed though the secondary transfer nip is then separated from the intermediate transfer belt 14 and fed to the fixing unit 80. The transfer sheet P is fed upward in FIG. 9 while being sandwiched by the fixing nip in the fixing unit 80. During this process, the transfer sheet P is heated and pressurized by the fixing belt 84, and the full-color toner image is fixed on the transfer sheet P.

The transfer sheet P having the fixed image thereon is passed through an ejection roller pair 87 and ejected outside the printer 500. On the top surface of the housing of the printer 500, a stack part 88 is formed. The transfer sheets P ejected by the ejection roller pair 87 are successively stacked on the stack part 88.

Above the transfer unit 60, four toner cartridges 100Y, 100C, 100M, and 100K storing yellow toner, cyan toner, magenta toner, and black toner, respectively, are disposed. The yellow, cyan, magenta, and black toners stored in the respective toner cartridges 100Y, 100C, 100M, and 100K are supplied to the respective developing devices 5Y, 5C, 5M, and 5K in the respective image forming units 1Y, 1C, 1M, and 1K. The toner cartridges 100Y, 100C, 100M, and 100K are detachably mountable on the printer main body independent from the image forming units 1Y, 1C, 1M, and 1K.

Next, an image forming operation of the printer 500 is described below.

In response to receipt of a print execution signal from an operation panel, the charging roller 4 and the developing roller 51 are each applied with a predetermined voltage or current at a predetermined timing. Similarly, the light sources in the optical writing unit 40 and the neutralization lamp are each applied with a predetermined voltage or current at a predetermined timing. In synchronization of the application of voltage or current, the photoconductor 3 is driven to rotate in a direction indicated by arrow in FIG. 10 by a photoconductor driving motor.

As the photoconductor 3 rotates clockwise in FIG. 10, the surface of the photoconductor 3 is uniformly charged to a predetermined potential by the charging roller 4. The optical writing unit 40 emits the laser light L to the charged surface of the photoconductor 3 based on image information. A part of the surface of the photoconductor 3 irradiated with the laser light L is neutralized, thereby forming an electrostatic latent image.

The surface of the photoconductor 3 having the electrostatic latent image thereon is rubbed by a magnetic brush formed of the developer on the developing roller 51 at a position where the photoconductor 3 is facing the developing device 5. As a developing bias is applied to the developing roller 51, negatively-charged toner particles on the developing roller 51 are transferred onto the electrostatic latent image, thus forming a toner image. This image forming process is performed in each of the image forming units 1Y, 1C, 1M, and 1K to form yellow, cyan, magenta, and black toner images on the photoconductors 3Y, 3C, 3M, and 3K, respectively.

Thus, in the printer 500, the developing device 5 develops the electrostatic latent image formed on the photoconductor 3 with negatively-charged toner particles based on reversal development. In the present embodiment, an N/P (negative/positive) development system (in which toner particles are adhered to low-potential regions) and a non-contact charging roller are employed, but the development and charging systems are not limited thereto.

The toner images of yellow, cyan, magenta, and black formed on the respective photoconductors 3Y, 3C, 3M, and 3K are primarily transferred onto the surface of the intermediate transfer belt 14 in such a manner that they are superimposed on one another. Thus, a composite toner image is formed on the intermediate transfer belt 14.

The composite toner image (hereinafter "toner image" for simplicity) formed on the intermediate transfer belt 14 is transferred onto the transfer sheet P which has been fed from the first sheet feeding cassette 151 or second sheet feeding cassette 152, passed through the registration roller pair 55, and fed to the secondary transfer nip. The transfer sheet P is once stopped by being sandwiched by the registration roller pair 55, and then fed to the secondary transfer nip in synchronization with an entry of the leading edge of the toner image on the intermediate transfer belt 14 into the secondary transfer nip. The transfer sheet P having the transferred toner image thereon is then separated from the intermediate transfer belt 14 and fed to the fixing unit 80. As the transfer sheet P having the transferred toner image thereon is passed through the fixing unit 80, the toner image is fixed on the transfer sheet P by heat and pressure. The transfer sheet P having the fixed toner image thereon is ejected outside the printer 500 and stacked at the stack part 88.

On the other hand, after the toner image has been transferred from the surface of the intermediate transfer belt 14 onto the transfer sheet P in the secondary transfer nip, the belt cleaning unit 162 removes residual toner particles remaining on the surface of the intermediate transfer belt 14. Similarly, after the toner image has been transferred from the surface of the photoconductor 3 onto the intermediate transfer belt 14 in the primary transfer nip, the cleaner 6 removes residual toner particles remaining on the surface of the photoconductor 3. The lubricant applicator 10 then applies a lubricant to the cleaned surface and the neutralization lamp further neutralizes the surface.

As illustrated in FIG. 10, the image forming unit 1 of the printer 500 has a frame body 2 accommodating the photoconductor 3 and processing devices including the charging roller 4, the developing device 5, the cleaner 6, and the lubricant applicator 10. The image forming unit 1 is temporarily detachable from the main body of the printer 500 as a process cartridge. Thus, in the printer 500, the photoconductor 3 and the processing devices are replaceable at the same time by replacing the image forming unit 1 as the process cartridge. Alternatively, each of the photoconductor 3, the charging roller 4, the developing device 5, the cleaner 6, and the lubricant applicator 10 may be independently replaceable.

EXAMPLES

The embodiments of the present invention are further described in detail with reference to the following Examples but are not limited to these Examples. In the following descriptions, "parts" and "%" represent "parts by mass" and "% by mass", respectively.

Preparation of Substrate of Elastic Member

As the substrate of the elastic member, a urethane rubber having a JIS-A hardness of 75 degrees, a rebound resilience of 45% at 23 degrees C., and a Martens hardness (HM) of 0.9 $N/m^2$ was prepared by centrifugal molding.

The JIS-A hardness on the lower surface side of the substrate of the elastic member was measured using a micro durometer MD-1 available from Kobunshi Keiki Co., Ltd. according to JTS K6253 at 23 degrees C.

The rebound resilience of the substrate of the elastic member was measured using a resilience tester No. 221 available from Toyo Seiki Seisaku-sho, Ltd. according to JIS K6255 at 23 degrees C. As the measurement specimen, a laminate in which sheets each having a thickness of 2 mm were laminated to have a total thickness of 4 mm or more was used.

The Martens hardness of the substrate of the elastic member was measured according to the method described above.

Preparation of Curable Composition

A curable composition for forming the surface layer was prepared from the materials listed below.

—Isocyanates—

MDI (4,4'-diphenylmethane diisocyanate): MILLIONATE MT manufactured by Tosoh Corporation Hydrogenated MDI (dicyclohexylmethane 4,4'-diisocyanate): manufactured by Tokyo Chemical Industry Co., Ltd.

TDI (2,4-tolylene diisocyanate): CORONATE T-100 manufactured by Tosoh Corporation —Polyols—

PTMG (polytetramethylene ether glycol): PTMG 1000, PTMG 2000, and PTM G3000 manufactured by Mitsubishi Chemical Corporation —Curing Agents—

DDM (4,4'-diaminodiphenylmethane): manufactured by Tokyo Chemical Industry Co., Ltd.

TMP (trimethylolpropane): manufactured by Mitsubishi Gas Chemical Company, Inc.

—Catalysts—

Dioctyltin dilaurate: NEOSTANN U-810 manufactured by Nitto Kasei Co., Ltd.

—Siloxane Compounds—

SH8400: polyether-modified silicone oil manufactured by Dow Corning Toray Co., Ltd.

FZ-2110: polyether-modified silicone oil manufactured by Dow Corning Toray Co., Ltd.

SF8416: alkyl-modified silicone oil manufactured by Dow Corning Toray Co., Ltd.

As presented in Table 1, an isocyanate and a polyol were mixed and stirred under a nitrogen purge at 80 degrees C. for 180 minutes to cause a reaction, thereby forming each of prepolymers 1 to 4 having NCO groups at both terminals with a desired proportion (%) of NCO.

TABLE 1

| | Isocyanate | Polyol | NCO (%) |
|---|---|---|---|
| Prepolymer 1 | MDI | PTMG 3000 | 7.5 |
| Prepolymer 2 | Hydrogenated MDI | PTMG 2000 | 3.9 |
| Prepolymer 3 | TDI | PTMG 2000 | 2.4 |
| Prepolymer 4 | Hydrogenated MDI | PTMG 1000 | 11.5 |

A prepolymer, a curing agent, a catalyst, and a siloxane compound, in an equivalent ratio (equivalent of NCO groups in the prepolymer/equivalent of $NH_2$ groups and OH groups in the curing agent) presented in Tables 2-1, 2-2, and 3, were mixed under a vacuum atmosphere at room temperature for 3 minutes, then sufficiently defoamed. Thus, a curable composition was prepared.

DDM and TMP as the curing agents were diluted with MEK (methyl ethyl ketone) so as to have a solid content of 40% and 10%, respectively.

Preparation of Reactive Precursor of Polyester Resin

In a reaction vessel equipped with a condenser tube, a stirrer, and a nitrogen introducing tube, diol components including ethylene oxide 2-mol adduct of bisphenol A and propylene oxide 2-mol adduct of bisphenol A in a molar ratio of 80:20, dicarboxylic acid components including terephthalic acid and adipic acid in a molar ratio of 85:15, and 1.0% by mol of trimellitic anhydride based on all the monomers were put in such amounts that the molar ratio of hydroxyl groups to carboxyl groups (OH/COOH) became 1.2. Further, tetrabutyl orthotitanate as a condensation catalyst in an amount of 1,000 ppm of all the monomers was put in the vessel. The temperature was raised to 200 degrees C. over a period of 2 hours under a nitrogen gas stream and further raised to 230 degrees C. over a period of 2 hours, and a reaction was conducted for 3 hours while distilling off the produced water. The reaction was further continued under reduced pressures of from 5 to 15 mmHg for 5 hours. Thus, an intermediate polyester having a weight average molecular weight of 10,000 was prepared. The glass transition temperature of the intermediate polyester determined from the DSC curve obtained in the first temperature rising in DSC (differential scanning calorimetry) was 55 degrees C.

Next, in a reaction vessel equipped with a condenser tube, a stirrer, and a nitrogen introducing tube, the intermediate polyester and isophorone diisocyanate (IPDI) were put in amounts such that the molar ratio (NCO/OH) of isocyanate groups in IPDT to hydroxyl groups in the intermediate polyester became 2.0, then dissolved in ethyl acetate, thus preparing a 50% ethyl acetate solution. After that, the ethyl acetate solution was heated to 80 degrees C. under a nitrogen gas stream and subjected to a reaction for 5 hours. Thus, an ethyl acetate solution of a reactive precursor a was prepared.

The molecular weight distribution and the weight average molecular weight (Mw) of a resin was measured by a gel permeation chromatographic (GPC) instrument (such as HLC-8220 GPC available from Tosoh Corporation). As a column, TSKgel SuperHZM-H 15 cm in 3-tandem (available from Tosoh Corporation) was used. The resin to be measured was dissolved in tetrahydrofuran (THF, containing a stabilizer, available from FUJIFILM Wako Pure Chemical Corporation) to prepare a 0.15% by mass solution thereof. The solution was filtered with a 0.2-μm filter, and the resulting filtrate was used as a specimen. Next, 100 μl of the specimen (i.e., THF solution of the resin) was injected into the instrument and subjected to a measurement at 40 degrees C. and a flow rate of 0.35 ml/min.

A molecular weight was calculated using a calibration curve created from monodisperse polystyrene standard samples. As the monodisperse polystyrene standard samples, Showdex STANDARD series available from Showa Denko K.K. and toluene were used.

The following three types of THF solutions A, B, and C of monodisperse polystyrene standard samples were prepared and subjected to a measurement under the above-described conditions. A calibration curve was created with light-scattering molecular weights of the monodisperse polystyrene standard samples that are represented by retention time of the peaks.

Solution A: 2.5 mg of S-7450, 2.5 mg of S-678, 2.5 mg of S-46.5, 2.5 mg of S-2.90, and 50 mL of THF Solution B: 2.5 mg of S-3730, 2.5 mg of S-257, 2.5 mg of S-19.8, 2.5 mg of S-0.580, and 50 mL of THF Solution C: 2.5 mg of S-1470, 2.5 mg of S-112, 2.5 mg of S-6.93, 2.5 mg of toluene, and 50 mL of THF As the detector, an RI (refractive index) detector was used.

The glass transition temperatures of toners and resins were measured using a differential scanning calorimeter (DSC) (Q-200 available from TA Instruments) as follows. First, about 5.0 mg of a sample was put in an aluminum sample container. The sample container was put on a holder unit and set in an electric furnace. As a reference, 10 mg of alumina was put in an aluminum sample container in the same manner as the sample. In a measurement, the sample container was heated from −80 degrees C. to 150 degrees C. at a temperature rising rate of 10 degrees C./min ("first heating process") in a nitrogen gas atmosphere. Subsequently, the sample container was cooled from 150 degrees C. to −80 degrees C. at a temperature falling rate of 10 degrees C./min ("cooling process") and heated to 150 degrees C. again at a temperature rising rate of 10 degrees C./min ("second heating process"). During these processes, a change in the amount of heat absorption/generation was measured. A DSC curve was obtained by drawing a graph showing a relation between the temperature and the amount of heat absorption/generation. The obtained DSC curves were analyzed with an analysis program installed in the system of Q-200. The glass transition temperature of the sample was determined by selecting the DSC curve obtained in the first heating process and determining the intersection of an extended line of the base line of the DSC curve at a temperature lower than the temperature at which enthalpy relaxation of the amount of heat absorption occurs, and a tangent line of the DSC curve indicating the maximum inclination at the enthalpy relaxation. In the case of a sample having a melting point, the peak top temperature at which the amount of heat absorption becomes maximum in the DSC curve obtained in the first heating process was determined as the melting point.

Preparation of Polyester Resin

In a reaction vessel equipped with a condenser tube, a stirrer, and a nitrogen introducing tube, diol components including ethylene oxide 2-mol adduct of bisphenol A and propylene oxide 2-mol adduct of bisphenol A in a molar ratio of 85:15 and dicarboxylic acid components including isophthalic acid and adipic acid in a molar ratio of 80:20 were put in amounts such that the molar ratio of hydroxyl groups to carboxyl groups (OH/COOH) became 1.2. Further, tetrabutyl orthotitanate as a condensation catalyst in an amount of 1,000 ppm of all the monomers was put in the vessel. The temperature was raised to 230 degrees C. over a period of 2 hours, and a reaction was conducted for 5 hours while distilling off the produced water. After that, the reaction was continued under reduced pressures of from 5 to 15 mmHg for 4 hours, then the reaction system was cooled to 180 degrees C. Trimellitic anhydride in an amount of 1.0% by mol of all the monomers and tetrabutyl orthotitanate in an amount of 200 ppm of all the monomers were further put in the vessel, and a reaction was conducted at 180 degrees C. at normal pressure for 1 hour. The reaction was further continued under reduced pressures of from 5 to 20 mmHg for 3 hours. Thus, a polyester resin B was prepared. The glass transition temperature determined from the DSC curve obtained in the first temperature rising in DSC (differential scanning calorimetry) was 47 degrees C., and the weight average molecular weight was 5,800.

Preparation of Crystalline Polyester Resin Dispersion Liquid

In a reaction vessel equipped with a condenser tube, a stirrer, and a nitrogen introducing tube, ethylene glycol as a diol component and sebacic acid as a dicarboxylic acid component were put in amounts such that the molar ratio of hydroxyl groups to carboxyl groups (OH/COOH) became 1.2. Further, titanium dihydroxybis(triethanolaminate) as a condensation catalyst in an amount of 500 ppm of all the monomers was put in the vessel. The temperature was raised to 180 degrees C. over a period of 2 hours, and a reaction was conducted for 8 hours while distilling off the produced water. Next, while the temperature was gradually raised to 220 degrees C., the reaction was continued under a nitrogen gas flow for 4 hours under reduced pressures of from 5 to 20 mmHg while distilling off the produced water. Thus, a crystalline polyester resin having a melting point of 75 degrees C. and a weight average molecular weight of 12,000 was prepared.

Next, in a reaction vessel equipped with a condenser tube, a thermometer, and a stirrer, 10 parts by mass of the crystalline polyester resin and 90 parts by mass of ethyl acetate were put, heated to 78 degrees C. to get dissolved, and cooled to 30 degrees C. over a period of 1 hour while being stirred. After that, the resulting liquid was subjected to a wet pulverization treatment using an ULTRAVISCOMILL (available from AIMEX CO., Ltd.) filled with 80% by volume of zirconia beads having a diameter of 0.5 mm, at a liquid feeding speed of 1.0 kg/hour and a disc peripheral speed of 10 m/sec. This dispersing operation was repeated 6 times (6 passes). An amount of ethyl acetate was added to adjust the solid content concentration. Thus, a crystalline polyester resin dispersion liquid having a solid content concentration of 10% was prepared.

Preparation of Colorant Master Batch

First, 100 parts by mass of the polyester resin B, 100 parts by mass of a black pigment (carbon black), and 50 parts by mass of ion-exchange water were well mixed and kneaded using an open roll kneader (NEADEX available from NIPPON COKE & ENGINEERING. CO., LTD. (former Mitsui Mining Co., Ltd.)). The kneading temperature was initially 80 degrees C. and thereafter raised to 120 degrees C. By removing water, a colorant master batch was prepared in which the mass ratio between the resin and the pigment was 1:1.

Preparation of Wax Dispersion Liquid

In a reaction vessel equipped with a condenser tube, a thermometer, and a stirrer, 20 parts by mass of a paraffin wax (HNP-9 available from Nippon Seiro Co., Ltd., having a melting point of 75 degrees C.) and 80 parts by mass of ethyl acetate were put, heated to 78 degrees C. to get dissolved, and cooled to 30 degrees C. over a period of 1 hour while being stirred. After that, the resulting liquid was subjected to a wet pulverization treatment using an ULTRAVISCOMILL (available from AIMEX CO., Ltd.) filled with 80% by volume of zirconia beads having a diameter of 0.5 mm, at a liquid feeding speed of 1.0 kg/hour and a disc peripheral speed of 10 m/sec. This dispersing operation was repeated 6 times (6 passes). An amount of ethyl acetate was added to adjust the solid content concentration. Thus, a wax dispersion liquid having a solid content concentration of 20% was prepared.

Preparation of Resin Particle Emulsion (Particle Size Controlling Agent)

In a reaction vessel equipped with a condenser tube, a stirrer, and a thermometer, 683 parts of water, 11 parts of a sodium salt of a sulfate of ethylene oxide adduct of methacrylic acid (ELEMINOL RS-30 manufactured by Sanyo Chemical Industries, Ltd.), 83 parts of styrene, 83 parts of methacrylic acid, 110 parts of butyl acrylate, and 1 part of ammonium persulfate were put and stirred at a revolution of 400 rpm for 15 minutes. After that, the temperature was raised to 75 degrees C. and a reaction was conducted for 5 hours. Further, 30 parts of a 1% by mass aqueous solution of ammonium persulfate was added to the vessel and heated at 75 degrees for 5 hours. As a result, a resin particle emulsion was prepared that was a particle size controlling agent comprising a copolymer of styrene, methacrylic acid, butyl acrylate, and a sodium salt of a sulfate of ethylene oxide adduct of methacrylic acid.

The volume average particle diameter of the resin particle emulsion measured by an instrument LA-920 was 50 nm.

Preparation of Carrier

As core materials, 5,000 parts by mass of Mn (manganese) ferrite particles (having a weight average particle diameter of 35 μm) were used. A coating liquid was prepared by dispersing 300 parts by weight of toluene, 300 parts by weight of butyl cellosolve, 60 parts by weight of a toluene solution of an acrylic resin (compositional ratio=methacrylic acid:methyl methacrylate:2-hydroxyethyl acrylate=5:9:3, Tg=38 degrees C.) having a solid content concentration of 50% by mass, 15 parts by weight of a toluene solution of N-tetramethoxymethylbenzoguanamine resin (having a polymerization degree of 1.5) having a solid content concentration of 77% by mass, and 15 parts by weight of alumina particles (having an average primary particle diameter of 0.30 μm) with a stirrer for 10 minutes. The core materials and the coating liquid were put into a coating device equipped with a fluidized bed having a rotary bottom disc and stirring blades, configured to generate a swirl flow, so that the coating liquid was applied to the core material. The coated core materials were calcined in an electric furnace at 220 degrees C. for 2 hours. Thus, a carrier was prepared.

Example 1

Preparation of Cleaning Blade

On a strip-shaped substrate having a thickness of 1.8 mm, a masking was made on the lower surface with leaving a width of 4 mm from the leading end surface of the substrate. A curable composition presented in Table 2-1 or 2-1 was applied to the lower surface of the substrate to form a surface layer having an average thickness of 150 μm.

Specifically, the lower surface of the substrate was overcoated by spray coating at a spray gun moving speed of 6 mm/s from the leading end surface of the substrate. After that, the masking was removed, and the substrate was heated in a thermostatic chamber at 90 degrees C. for 1 hour, then left in a thermostatic chamber at 45 degrees C. and 90% RH for 48 hours to complete the reaction. The substrate was then cut at a position 1 mm away from the leading end surface to form a contact part.

Next, the resulted elastic member having the surface layer formed on the contact part was fixed to a sheet metal holder (support) with an adhesive, so that the elastic member was mountable on a color multifunction peripheral (IMAGIO MP C4500 manufactured by Ricoh Co., Ltd.). Thus, a blade 1 was prepared that was a cleaning blade having the surface layer formed on the contact part. Properties of the cleaning blade thus prepared are presented in Table 2-1 or 2-1.

In Table 2-1 or 2-1, "Formation Region of Surface Layer" represents the length of the surface layer from the contact part of the blade in a surface direction of the lower surface of the substrate.

Average Thickness of Surface Layer

Figure 11:
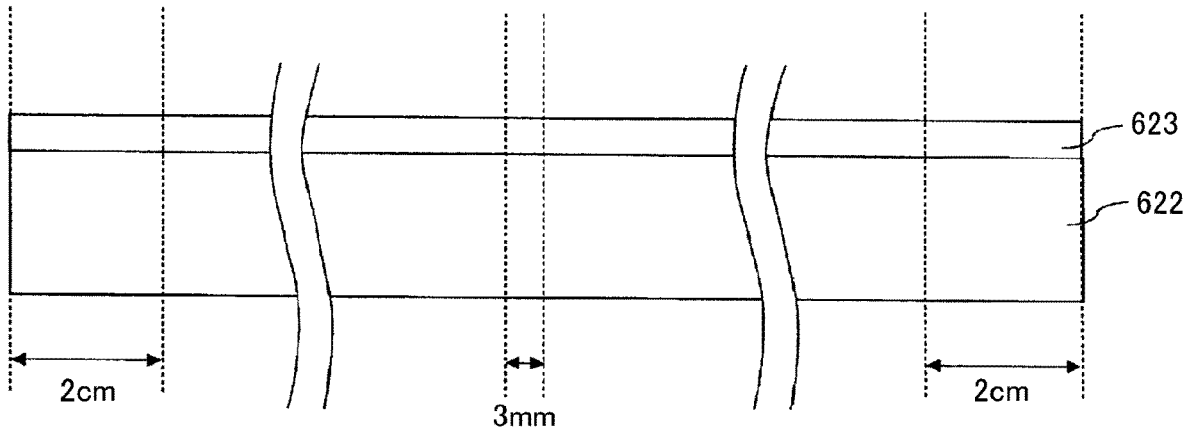
FIG. 11 is a diagram for explaining a method for measuring an average thickness of a surface layer.

FIG. 11 is a cross-sectional diagram illustrating a measurement position for measuring the thickness of the contact part of the cleaning blade.

As illustrated in FIG. 11, the elastic member was sliced at a plane orthogonal to the longitudinal direction, and the slice was observed with a digital microscope VHX-2000 (available from Keyence Corporation) with the cross section facing upward. The measurement position corresponds to the contact part (leading end ridge part) of the blade in the cross section. The elastic member was sliced to have a thickness of 3 mm in the longitudinal direction of the elastic member by being cut with a razor in a direction perpendicular to the longitudinal direction of the elastic member. At this time, by using a vertical slicer, the cross section becomes more evenly. The longitudinal position where the elastic member was sliced was not within a region extending from each end for a distance of 2 cm in the longitudinal direction.

Martens Hardness HM of Surface Layer

The Martens hardness (HM) of the surface layer in each Example or Comparative Example was measured in the manner as described above. The measurement position was m away from the leading end ridge part in the depth direction. The measurement position was not within a region extending from each end for a distance of 2 cm in the longitudinal direction.

Coefficient μk of Kinetic Friction

The cleaning blade was pressed against a metal plate having a 150-μm thick PET sheet on its surface (at a cleaning angle of 79 degrees and a linear pressure of 20 g/cm) and moved at a speed of 20 mm/s to measure the coefficient k of kinetic friction.

Preparation of Toner

In a vessel equipped with a stirrer and a thermometer, 75 parts by mass of ion-exchange water, 1 part by mass of carboxymethylcellulose sodium, 16 parts by mass of a 48.5% aqueous solution of dodecyl diphenyl ether sodium disulfonate (ELEMINOL MON-7 available from Sanyo Chemical Industries, Ltd.), and 5 parts of ethyl acetate were mixed and stirred. Further, 0.3 parts of the resin particle emulsion based on solid contents was added to prepare an aqueous phase solution.

Next, in another vessel equipped with a thermometer and a stirrer, 78 parts by mass of the polyester resin B, 70 parts by mass of the crystalline polyester resin dispersion liquid, 25 parts by mass of the wax dispersion liquid, and 16 parts by mass of the colorant masterbatch were stirred and dissolved in ethyl acetate such that the solid content concentration became 30% by mass. The vessel contents were further stirred by a TK HOMOMIXER (available from PRIMIX Corporation) at a revolution of 8,000 rpm for uniform dissolution and dispersion. Further, isophoronediamine (IPDA) in an amount such that the molar ratio ($NH_2$/NCO) of amino groups in IPDA to isocyanate groups in the reactive precursor a became 0.98 was put therein and stirred using a TK HOMOMIXER at a revolution of 8,000 rpm for 15 seconds. Next, 30 parts by mass of a 50% ethyl acetate solution of the reactive precursor a were put therein and stirred using a TK HOMOMIXER at a revolution of 8,000 rpm for 30 seconds. Thus, an oil phase 1 was prepared.

Immediately after the preparation of the oil phase 1, 50 parts by mass of the oil phase 1 were added to the aqueous phase and mixed using a TK HOMOMIXER (available from PRIMIX Corporation) at a liquid temperature of from 30 to 40 degrees C. and a revolution of 12,000 rpm for 1 minute. Thus, an emulsion slurry was prepared.

Next, in another vessel equipped with a stirrer, a nitrogen introducing tube, and a thermometer, the obtained emulsion slurry was heated to 50 degrees C. while being stirred. Ethyl acetate was distilled off under a nitrogen gas flow. The pH of the slurry was adjusted to 12 by adding a 10% by mass aqueous solution of sodium hydroxide. Next, the slurry was heated in a 45 degrees C. environment for 10 hours so that the particle size controlling agent adhering to the surfaces of oil droplets were dissolved and removed, then subject to suction filtration to obtain solid contents.

The above-obtained solid contents were subjected to the following washing processes (1) to (4).

(1) The solid contents were mixed with 100 parts by mass of ion-exchange water using a TK HOMOMIXER (at a revolution of 6,000 rpm for 5 minutes) and thereafter filtered, thus obtaining solid contents.

(2) The solid contents obtained in (1) were mixed with 100 parts by mass of a 10% by mass aqueous solution of sodium hydroxide using a TK HOMOMIXER (at a revolution of 6,000 rpm for 10 minutes) and thereafter filtered under reduced pressures, thus obtaining solid contents.

(3) The solid contents obtained in (2) were mixed with 100 parts by mass of a 10% by mass aqueous solution of hydrochloric acid using a TK HOMOMIXER (at a revolution of 6,000 rpm for 5 minutes) and thereafter filtered under reduced pressures, thus obtaining solid contents.

(4) The solid contents obtained in (3) were mixed with 300 parts by mass of ion-exchange water using a TK HOMOMIXER (at a revolution of 6,000 rpm for 5 minutes) and thereafter filtered. This operation was repeated twice, thus obtaining solid contents.

The solid contents having been washed were dried by a circulating air dryer at 45 degrees C. for 48 hours and thereafter sieved with a mesh having an opening of 75 μm. Thus, toner base particles 1 were prepared.

The toner base particles 1 in an amount of 100 parts by mass were mixed with 1.0 part by mass of a hydrophobic silica (HDK-2000 available from Wacker Chemie AG) and 0.3 parts by mass of a titanium oxide (MT-150AI available from Tayca Corporation) using a HENSCHEL MIXER. Thus, a toner 1 was prepared. The tensile breaking force F and the amount of the crystalline resin present at the surface of toner were measured in the manner described above, and the results are presented in Table 2-1 or 2-1.

Tensile Breaking Force F

The tensile breaking force F of the toner obtained in each Example or Comparative Example was measured in the manner as described above.

Amount of Crystalline Resin Present at Surface

The amount of the crystalline resin present at the surface of the toner obtained in each Example or Comparative Example was measured in the manner as described above.

In the present disclosure, in an IR spectrum of the toner, a peak derived from carbonyl group observed at around 1737 to 1739 $cm^{-1}$ was treated as the peak derived from the crystalline resin, and a peak derived from p-substituted benzene observed at around 827 to 829 cm was treated as the peak derived from the binder resin. The intensity ratio (Pc/Pr) was calculated therefrom.

Standard samples for creating a calibration curve were prepared as follows. First, a toner for creating calibration curve was prepared in the same manner as in each Example or Comparative Example except for not using the crystalline polyester resin dispersion liquid. The toner for creating calibration curve was mixed with the crystalline polyester resin powder in each amount of 0 part by mass (surface presence ratio: 0% by mass), 10 parts by mass (surface presence ratio: 10% by mass), 20 parts by mass (surface presence ratio: 20% by mass), 40 parts by mass (surface presence ratio: 40% by mass), and 80 parts by mass (surface presence ratio: 80% by mass) and sufficiently ground in an agate mortar, thus preparing standard samples for creating a calibration curve.

Preparation of Developer

The carrier in an amount of 100 parts by mass and the toner 1 in an amount of 7 parts by mass were uniformly mixed by a TURBLA mixer (available from Willy A. Bachofen AG), configured to perform stirring by rolling of a container, at a revolution of 48 rpm for 5 minutes. Thus, a developer 1, which was a two-component developer, was prepared.

Preparation of Image Forming Apparatus

The above-prepared cleaning blade was mounted on a process cartridge for a color multifunction peripheral (IMAGIO MP C4500 manufactured by Ricoh Co., Ltd.), the printer part of which having the same configuration as the printer 500 illustrated in FIG. 10, to assemble an image forming apparatus in each Example or Comparative Example.

Figure 12A:
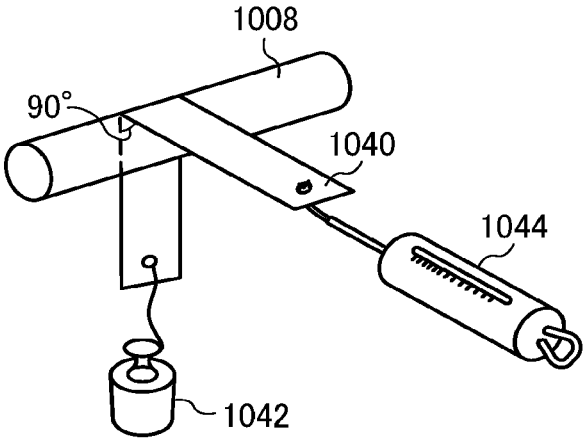
FIGS. 12A and 12B are perspective and side views, respectively, illustrating a method for measuring the coefficient of friction of a photoconductor.
Figure 12B:
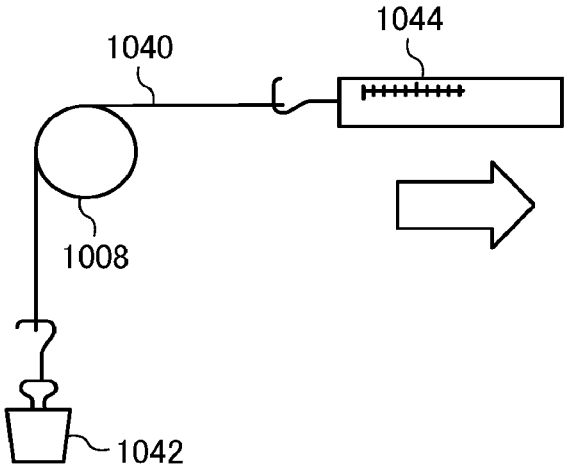

The cleaning blade was mounted on the image forming apparatus with a linear pressure of 15 g/cm and a cleaning angle of 79 degrees. The image forming apparatus was equipped with a lubricant application device. The coefficient of static friction of the surface of the photoconductor was maintained at 0.2 or less during non-image forming periods by application of the lubricant to the photoconductor. The coefficient of static friction of the surface of the photoconductor was measured based on the Euler belt method described in, for example, paragraph [0046] of JP-H09-166919-A. Specifically, referring to FIGS. 12A and 12B, a substantially central part of a measurement sheet (generally a copy sheet) 1040, having been cut to have a certain width (for example, about 20 mm), was wound around the photoconductor 1008 with an angle of about 90 degrees. A weight 1042 having a predetermined weight was attached to one end of the measurement sheet 1040, and a tension gage 1044 was attached to the other end. Next, the measurement sheet 1040 on the surface of the photoconductor 1008 was pulled at a constant speed (about 100±20 mm/min) without the weight 1042 swinging. At the time when the measurement sheet 1040 started moving on the photoconductor 1008, the tension gage 1044 was read.

Cleaning Performance

In a laboratory environment at 21 degrees C. and 65% RH, an image chart having an image area ratio of 5% was output on 50,000 sheets (A4 size, lateral) at 3 prints/job using the image forming apparatus.

After that, in a laboratory environment at 32 degrees C. and 54% RH, a test image chart having three vertical band patterns (in the sheet advancing direction) having a width of 43 mm was output on 100 sheets (A4 size, lateral). The resultant image was visually observed to confirm the presence or absence of an image abnormality due to defective cleaning, and the cleaning performance was evaluated based on the following criteria.

Evaluation Criteria

A+: Toner particles having slipped through due to defective cleaning are not visually confirmed on either the print sheet or the photoconductor, and no streak-like toner slippage is confirmed even when the photoconductor is observed with a microscope in the longitudinal direction.

A: Toner particles having slipped through due to defective cleaning are not visually confirmed on either the print sheet or the photoconductor.

B: Toner particles having slipped through due to defective cleaning are visually confirmed on both the print sheet and the photoconductor, but it is acceptable.

C: Toner particles having slipped through due to defective cleaning are visually confirmed on both the print sheet and the photoconductor, and it is unacceptable.

Filming of Additives

In a laboratory environment of 27 degrees C. and 90% RH, a vertical band chart having an image area ratio of 30% was output on 5,000 sheets (A4 size, lateral) at 3 prints/job, then 5,000 blank sheets (A4 size, lateral) were output at 3 prints/job, and a halftone image was printed on one sheet, using the image forming apparatus. After that, the photoconductor was visually observed.

Evaluation Criteria

A+: No problem with the photoconductor. No problem in quality.

A: Filming is slightly observed in the direction of printing, but there is no problem in image quality.

C: Filming is clearly observed on the photoconductor, and there is a problem in image quality.

The evaluation results are presented in Table 2-1 or 2-1.

Example 2

A curable composition presented in Table 2-1 or 2-1 was applied to the lower surface of the substrate to form a surface layer having an average thickness of 300 μm as the same manner in Example 1. Thus, a blade 2 as a cleaning blade was prepared. Properties of the cleaning blade thus prepared are presented in Table 2-1 or 2-1.

An image forming apparatus was prepared in the same manner as in Example 1 except that the blade 1 was replaced with the blade 2, and the evaluation was conducted. The evaluation results are presented in Table 2-1 or 2-1.

Example 3

The procedure in Example 1 was repeated except that, in the preparation of the toner, the amount of the polyester resin B was changed from 78 parts by mass to 80 parts by mass and the amount of the crystalline polyester resin dispersion liquid was changed from 70 parts by mass to 50 parts by mass. Thus, a toner 2 and a developer 2 were prepared.

An image forming apparatus was prepared in the same manner as in Example 1 except that the blade 1 was replaced with the blade 2 and the developer 1 was replaced with the developer 2, and the evaluation was conducted. The evaluation results are presented in Table 2-1 or 2-1.

Example 4

The procedure in Example 1 was repeated except that, in the preparation of the toner, the amount of the polyester resin B was changed from 78 parts by mass to 75 parts by mass and the amount of the crystalline polyester resin dispersion liquid was changed from 70 parts by mass to 100 parts by mass. Thus, a toner 3 and a developer 3 were prepared.

An image forming apparatus was prepared in the same manner as in Example 1 except that the blade 1 was replaced with the blade 2 and the developer 1 was replaced with the developer 3, and the evaluation was conducted. The evaluation results are presented in Table 2-1 or 2-1.

Example 5

A curable composition presented in Table 2-1 or 2-1 was applied to the lower surface of the substrate to form a surface layer having an average thickness of 200 μm as the same manner in Example 1. Thus, a blade 3 as a cleaning blade was prepared. Properties of the cleaning blade thus prepared are presented in Table 2-1 or 2-1.

An image forming apparatus was prepared in the same manner as in Example 1 except that the blade 1 was replaced with the blade 3, and the evaluation was conducted. The evaluation results are presented in Table 2-1 or 2-1.

Example 6

A curable composition presented in Table 2-1 or 2-1 was applied to the lower surface of the substrate to form a surface layer having an average thickness of 80 μm as the same manner in Example 1. Thus, a blade 4 as a cleaning blade was prepared. Properties of the cleaning blade thus prepared are presented in Table 2-1 or 2-1.

An image forming apparatus was prepared in the same manner as in Example 1 except that the blade 1 was replaced with the blade 4, and the evaluation was conducted. The evaluation results are presented in Table 2-1 or 2-1.

Example 7

A curable composition presented in Table 2-1 or 2-1 was applied to the lower surface of the substrate to form a surface layer having an average thickness of 50 μm as the same manner in Example 1. Thus, a blade 5 as a cleaning blade was prepared. Properties of the cleaning blade thus prepared are presented in Table 2-1 or 2-1.

An image forming apparatus was prepared in the same manner as in Example 1 except that the blade 1 was replaced with the blade 5, and the evaluation was conducted. The evaluation results are presented in Table 2-1 or 2-1.

Example 8

A curable composition presented in Table 2-1 or 2-1 was applied to the lower surface of the substrate to form a surface layer having an average thickness of 500 μm as the same manner in Example 1. Thus, a blade 6 as a cleaning blade was prepared. Properties of the cleaning blade thus prepared are presented in Table 2-1 or 2-1.

An image forming apparatus was prepared in the same manner as in Example 1 except that the blade 1 was replaced with the blade 6, and the evaluation was conducted. The evaluation results are presented in Table 2-1 or 2-1.

Example 9

A curable composition presented in Table 2-1 or 2-1 was applied to the lower surface of the substrate to form a surface layer having an average thickness of 20 μm as the same manner in Example 1. Thus, a blade 7 as a cleaning blade was prepared. Properties of the cleaning blade thus prepared are presented in Table 2-1 or 2-1.

An image forming apparatus was prepared in the same manner as in Example 1 except that the blade 1 was replaced with the blade 7, and the evaluation was conducted. The evaluation results are presented in Table 2-1 or 2-1.

Example 10

A curable composition presented in Table 2-1 or 2-1 was applied to the lower surface of the substrate to form a surface layer having an average thickness of 600 μm as the same manner in Example 1. Thus, a blade 8 as a cleaning blade was prepared. Properties of the cleaning blade thus prepared are presented in Table 2-1 or 2-1.

An image forming apparatus was prepared in the same manner as in Example 1 except that the blade 1 was replaced with the blade 8, and the evaluation was conducted. The evaluation results are presented in Table 2-1 or 2-1.

Example 11

A curable composition presented in Table 2-1 or 2-1 was applied to the lower surface of the substrate to form a surface layer having an average thickness of 5 μm as the same manner in Example 1. Thus, a blade 9 as a cleaning blade was prepared. Properties of the cleaning blade thus prepared are presented in Table 2-1 or 2-1.

An image forming apparatus was prepared in the same manner as in Example 1 except that the blade 1 was replaced with the blade 9, and the evaluation was conducted. The evaluation results are presented in Table 2-1 or 2-1.

Example 12

A curable composition presented in Table 2-1 or 2-1 was applied to the lower surface of the substrate to form a surface layer having an average thickness of 300 μm as the same manner in Example 1, and the substrate was cut at a position 3 mm away from the leading end surface to form a contact part. Thus, a blade 10 as a cleaning blade was prepared. Properties of the cleaning blade thus prepared are presented in Table 2-1 or 2-1.

An image forming apparatus was prepared in the same manner as in Example 1 except that the blade 1 was replaced with the blade 10, and the evaluation was conducted. The evaluation results are presented in Table 2-1 or 2-1.

Example 13

A curable composition presented in Table 2-1 or 2-1 was applied to the lower surface of the substrate to form a surface layer having an average thickness of 300 μm as the same manner in Example 1, and the substrate was cut at a position 3.5 mm away from the leading end surface to form a contact part. Thus, a blade 11 as a cleaning blade was prepared. Properties of the cleaning blade thus prepared are presented in Table 2-1 or 2-1.

An image forming apparatus was prepared in the same manner as in Example 1 except that the blade 1 was replaced with the blade 11, and the evaluation was conducted. The evaluation results are presented in Table 2-1 or 2-1.

Comparative Example 1

The substrate used in Example 1 was used as it was as a blade 12. An image forming apparatus was prepared in the same manner as in Example 1 except that the blade 1 was replaced with the blade 12, and the evaluation was conducted. Properties and evaluation results of the cleaning blade are presented in Table 3.

Comparative Example 2

A curable composition presented in Table 3 was applied to the lower surface of the substrate to form a surface layer having an average thickness of 300 μm as the same manner in Example 1. Thus, a blade 13 as a cleaning blade was prepared. Properties of the cleaning blade thus prepared are presented in Table 3.

An image forming apparatus was prepared in the same manner as in Example 1 except that the blade 1 was replaced with the blade 13, and the evaluation was conducted. The evaluation results are presented in Table 3.

Comparative Example 3

A curable composition presented in Table 3 was applied to the lower surface of the substrate to form a surface layer having an average thickness of 100 μm as the same manner in Example 1. Thus, a blade 14 as a cleaning blade was prepared. Properties of the cleaning blade thus prepared are presented in Table 3.

An image forming apparatus was prepared in the same manner as in Example 1 except that the blade 1 was replaced with the blade 14, and the evaluation was conducted. The evaluation results are presented in Table 3.

Comparative Example 4

The procedure in Example 1 was repeated except that, in the preparation of the toner, the amount of the polyester resin B was changed from 78 parts by mass to 77 parts by mass, the amount of the crystalline polyester resin dispersion liquid was changed from 70 parts by mass to 30 parts by mass, and the amount of the reactive precursor a was changed from 30 parts by mass to 40 parts by mass. Thus, a toner 4 and a developer 4 were prepared.

An image forming apparatus was prepared in the same manner as in Example 1 except that the blade 1 was replaced with the blade 2 and the developer 1 was replaced with the developer 4, and the evaluation was conducted. The evaluation results are presented in Table 3.

Comparative Example 5

The procedure in Example 1 was repeated except that, in the preparation of the toner, the amount of the polyester resin B was changed from 78 parts by mass to 72 parts by mass and the amount of the crystalline polyester resin dispersion liquid was changed from 70 parts by mass to 130 parts by mass. Thus, a toner 5 and a developer 5 were prepared.

An image forming apparatus was prepared in the same manner as in Example 1 except that the blade 1 was replaced with the blade 2 and the developer 1 was replaced with the developer 5, and the evaluation was conducted. The evaluation results are presented in Table 3.

TABLE 2-1

| Materials | | | Examples 1 | 2 | 3 | 4 | 5 | 6 | 7 |
|---|---|---|---|---|---|---|---|---|---|
| Cleaning Blade | Cleaning Blade | | Blade 1 | Blade 2 | Blade 2 | Blade 2 | Blade 3 | Blade 4 | Blade 5 |
| | Prepolymer | Prepolymer 1 | 100 | — | — | — | — | — | — |
| | | Prepolymer 2 | — | 100 | 100 | 100 | 100 | 100 | — |
| | | Prepolymer 3 | — | — | — | — | — | — | 100 |
| | | Prepolymer 4 | — | — | — | — | — | — | — |
| | Curing Agent | DDM | 15.2 | 25.4 | 25.4 | 25.4 | 20.7 | 18.5 | 7.5 |
| | | TMP | 39.0 | — | — | — | — | 3.8 | 12.0 |
| | Catalyst | Dioctyltin Dilaurate | 3 | 3 | 3 | 3 | 3 | 3 | 3 |
| | Siloxane Compound | SH8400 | — | — | — | — | 10 | — | — |
| | | FZ-2110 | — | 20 | 20 | 20 | — | — | 15 |
| | | SF8416 | 20 | — | — | — | — | 10 | — |
| | Equivalent Ratio | | 1.2 | 0.9 | 0.9 | 0.9 | 1.1 | 1.1 | 1.0 |
| | Average Thickness of Surface Layer (μm) | | 150 | 300 | 300 | 300 | 200 | 80 | 50 |
| | Formation Region of Surface Layer (mm) | | 3 | 3 | 3 | 3 | 3 | 3 | 3 |
| | Martens Hardness | HM(1) | 26.3 | 14.0 | 14.0 | 14.0 | 20.2 | 17.4 | 9.8 |
| | HM | HM(50) | 14.4 | 6.8 | 6.8 | 6.8 | 11.8 | 10.2 | 7.4 |
| | ($N/mm^2$) | HM(1000) | 7.5 | 3.5 | 3.5 | 3.5 | 4.9 | 4.0 | 5.0 |
| | Creep CIT | CIT(1) | 10.4 | 13.5 | 13.5 | 13.5 | 9.8 | 11.6 | 11.2 |
| | (%) | CIT(50) | 7.3 | 10.8 | 10.8 | 10.8 | 8.5 | 9.1 | 8.8 |
| | | CIT(1000) | 4.5 | 7.5 | 7.5 | 7.5 | 6.3 | 5.0 | 6.4 |
| | Coefficient μk of Kinetic Friction | | 0.43 | 0.45 | 0.45 | 0.45 | 0.32 | 0.40 | 0.37 |
| Toner | Toner | | Toner 1 | Toner 1 | Toner 2 | Toner 3 | Toner 1 | Toner 1 | Toner 1 |
| | Tensile Breaking Force F | | 315 | 315 | 200 | 448 | 315 | 315 | 315 |
| | Amount of Crystalline Resin Present at Surface (% by weight) | | 23 | 23 | 15 | 60 | 23 | 23 | 23 |
| | Endurance Tests | Cleaning Performance | A | A | A+ | A | A+ | A+ | A |
| | | Filming | A+ | A+ | A | A+ | A+ | A+ | A+ |

TABLE 2-2

| Materials | | | Examples 8 | 9 | 10 | 11 | 12 | 13 |
|---|---|---|---|---|---|---|---|---|
| Cleaning Blade | Cleaning Blade | | Blade 6 | Blade 7 | Blade 8 | Blade 9 | Blade 10 | Blade 11 |
| | Prepolymer | Prepolymer 1 | — | — | — | — | — | — |
| | | Prepolymer 2 | 100 | — | 100 | — | 100 | 100 |
| | | Prepolymer 3 | — | — | — | 100 | — | — |
| | | Prepolymer 4 | — | 100 | — | — | — | — |
| | Curing Agent | DDM | 9.0 | 45.0 | 18.5 | 7.5 | 25.4 | 25.4 |
| | | TMP | 26.0 | — | 3.8 | 12.0 | — | — |
| | Catalyst | Dioctyltin Dilaurate | 3 | 3 | 3 | 3 | 3 | 3 |
| | Siloxane Compound | SH8400 | — | — | — | — | — | — |
| | | FZ-2110 | — | — | — | 15 | 20 | 20 |
| | | SF8416 | 10 | 20 | 10 | — | — | — |
| | Equivalent Ratio | | 1.0 | 1.5 | 1.1 | 1.0 | 0.9 | 0.9 |
| | Average Thickness of Surface Layer (μm) | | 500 | 20 | 600 | 5 | 300 | 300 |
| | Formation Region of Surface Layer (mm) | | 3 | 3 | 3 | 3 | 1 | 0.5 |
| | Martens Hardness | HM(1) | 7.5 | 32.5 | 18.3 | 9.2 | 14.0 | 14.0 |
| | HM | HM(50) | 4.4 | 17.8 | 12.0 | 6.5 | 6.8 | 6.8 |
| | ($N/mm^2$) | HM(1000) | 2.5 | 9.5 | 4.5 | 4.3 | 3.5 | 3.5 |
| | Creep CIT | CIT(1) | 12.4 | 10.0 | 11.8 | 9.7 | 13.5 | 13.5 |
| | (%) | CIT(50) | 9.0 | 6.2 | 9.1 | 8.6 | 10.8 | 10.8 |
| | | CIT(1000) | 6.5 | 3.0 | 5.8 | 6.0 | 7.5 | 7.5 |
| | Coefficient μk of Kinetic Friction | | 0.50 | 0.30 | 0.41 | 0.37 | 0.45 | 0.45 |
| Toner | Toner | | Toner 1 | Toner 1 | Toner 1 | Toner 1 | Toner 1 | Toner 1 |
| | Tensile Breaking Force F | | 315 | 315 | 315 | 315 | 315 | 315 |
| | Amount of Crystalline Resin Present at Surface (% by weight) | | 23 | 23 | 23 | 23 | 23 | 23 |
| | Endurance Tests | Cleaning Performance | A | A | A | B | A | B |
| | | Filming | A+ | A+ | A | A+ | A+ | A |

TABLE 3

| Materials | | | Comparative Examples 1 | 2 | 3 | 4 | 5 |
|---|---|---|---|---|---|---|---|
| Cleaning Blade | Cleaning Blade | | Blade 12 | Blade 13 | Blade 14 | Blade 2 | Blade 2 |
| | Prepolymer | Prepolymer 1 | — | — | — | — | — |
| | | Prepolymer 2 | — | 100 | — | 100 | 100 |
| | | Prepolymer 3 | — | — | — | — | — |
| | | Prepolymer 4 | — | — | 100 | — | — |
| | Curing Agent | DDM | — | 25.4 | 52.0 | 25.4 | 25.4 |
| | | TMP | — | — | — | — | — |
| | Catalyst | Dioctyltin Dilaurate | — | 3 | 3 | 3 | 3 |
| | Siloxane Compound | SH8400 | — | — | — | — | — |
| | | FZ-2110 | — | — | 15 | 20 | 20 |
| | | SF8416 | — | — | — | — | — |
| | Equivalent Ratio | | — | 0.9 | 1.3 | 0.9 | 0.9 |
| | Average Thickness of Surface Layer (μm) | | — | 300 | 100 | 300 | 300 |
| | Formation Region of Surface Layer (mm) | | — | 3 | 3 | 3 | 3 |
| | Martens Hardness | HM(1) | 4.0 | 15.1 | 52.4 | 14.0 | 14.0 |
| | HM | HM(50) | 1.0 | 7.3 | 41.9 | 6.8 | 6.8 |
| | ($N/mm^2$) | HM(1000) | 0.7 | 3.9 | 35.0 | 3.5 | 3.5 |
| | Creep CIT | CIT(1) | 3.8 | 12.6 | 9.3 | 13.5 | 13.5 |
| | (%) | CIT(50) | 1.1 | 10.0 | 6.8 | 10.8 | 10.8 |
| | | CIT(1000) | 0.7 | 6.9 | 2.8 | 7.5 | 7.5 |
| | Coefficient μk of Kinetic Friction | | 0.9 | 0.81 | 0.3 | 0.45 | 0.45 |
| Toner | Toner | | Toner 1 | Toner 1 | Toner 1 | Toner 4 | Toner 5 |
| | Tensile Breaking Force F | | 315 | 315 | 315 | 163 | 462 |
| | Amount of Crystalline Resin Present at Surface (% by weight) | | 23 | 23 | 23 | 8 | 67 |
| | Endurance Tests | Cleaning Performance | C | C | C | A | C |
| | | Filming | C | C | C | C | C |

It is clear from the results presented in Tables 2-1, 2-2, and 3 that, in each example, the occurrence of filming was prevented, excellent cleaning performance was maintained for an extended period of time, and the occurrence of an abnormal image is prevented.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming apparatus comprising:

an image bearer;

an electrostatic latent image forming device configured to form an electrostatic latent image on the image bearer;

a visible image forming device containing a toner, configured to develop the electrostatic latent image with the toner to form a visible image; and a cleaning blade configured to remove toner particles remaining on the image bearer, the cleaning blade comprising:

an elastic member configured to contact a surface of the image bearer to remove the toner particles remaining on the surface of the image bearer, the elastic member comprising:

a substrate; and a surface layer comprising a cured product of a curable composition, wherein the surface layer is disposed on at least a part of a lower surface of the substrate, where the lower surface includes a contact part of the elastic member with the image bearer, and the lower surface faces a downstream side of the contact part in a direction of movement of the image bearer, wherein the surface layer contains a siloxane compound, wherein the surface layer has a hardness gradient in which a Martens hardness HM measured using a nanoindenter decreases from a surface of the surface layer toward the lower surface of the substrate in a thickness direction, and the Martens hardness HM measured in a region extending from a vicinity of the surface (with a load of 1 μN) to a deepest part in the thickness direction (with a load of 1,000 μN) ranges from 2.5 to 32.5 $N/mm^2$, wherein the toner has a tensile breaking force F of from 200 to 450 gf (from 1.96 to 4.41 N), measured using a powder layer compression/tensile strength measurement device under a load of 32 kgf (313.81 N).

2. The image forming apparatus according to claim 1, wherein the curable composition comprises a polyurethane compound.

3. The image forming apparatus according to claim 1, wherein the siloxane compound comprises a modified silicone oil.

4. The image forming apparatus according to claim 1, wherein the surface layer has an average thickness of from 10 to 500 μm.

5. The image forming apparatus according to claim 1, wherein the surface layer has a gradient in creep property (CIT) in which the creep property (CIT) measured using the nanoindenter decreases from the surface of the surface layer toward the lower surface of the substrate, and the creep property (CIT) measured in a region extending from the vicinity of the surface (with a load of 1 μN) to the deepest part in the thickness direction (with a load of 1,000 μN) ranges from 3.0% to 13.5%.

6. The image forming apparatus according to claim 1, wherein the surface layer is disposed over a region extending from the contact part for a distance of at least 1 mm in a surface direction of the lower surface of the substrate.

7. The image forming apparatus according to claim 1, wherein the toner contains a crystalline resin, and a presence ratio of the crystalline resin at the surface of the toner is from 15% to 60% by mass, measured by an ATR (Attenuated Total Reflection) method using a Fourier transform infrared spectrometer (FT-IR).

8. An image forming method comprising:

forming an electrostatic latent image on an image bearer;

developing the electrostatic latent image with a toner to form a visible image; and removing toner particles remaining on the image bearer with a cleaning blade, wherein the cleaning blade comprises an elastic member configured to contact a surface of the image bearer to remove the toner particles remaining on the surface of the image bearer, the elastic member comprising:

a substrate; and a surface layer comprising a cured product of a curable composition, wherein the surface layer is disposed on at least a part of a lower surface of the substrate, where the lower surface includes a contact part of the elastic member with the image bearer, and the lower surface faces a downstream side of the contact part in a direction of movement of the image bearer, wherein the surface layer contains a siloxane compound, wherein the surface layer has a hardness gradient in which a Martens hardness HM measured using a nanoindenter decreases from a surface of the surface layer toward the lower surface of the substrate in a thickness direction, and the Martens hardness HM measured in a region extending from a vicinity of the surface (with a load of 1 μN) to a deepest part in the thickness direction (with a load of 1,000 μN) ranges from 2.5 to 32.5 $N/mm^2$, wherein the toner has a tensile breaking force F of from 200 to 450 gf (from 1.96 to 4.41 N), measured using a powder layer compression/tensile strength measurement device under a load of 32 kgf (313.81 N).

9. A process cartridge comprising the image forming apparatus according to claim 1.

* * * * *